US009384695B2

(12) United States Patent
Lee et al.

(10) Patent No.: US 9,384,695 B2
(45) Date of Patent: Jul. 5, 2016

(54) ORGANIC LIGHT-EMITTING DISPLAY APPARATUS

(71) Applicant: SAMSUNG DISPLAY CO., LTD., Yongin, Gyeonggi-Do (KR)

(72) Inventors: Jae-Hoon Lee, Yongin (KR); Sung-Jae Moon, Yongin (KR); Wang-Jo Lee, Yongin (KR); Jong-Hyun Choi, Yongin (KR); Yong-Duck Son, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 14 days.

(21) Appl. No.: 14/259,098

(22) Filed: Apr. 22, 2014

(65) Prior Publication Data

US 2015/0161931 A1 Jun. 11, 2015

(30) Foreign Application Priority Data

Dec. 5, 2013 (KR) ..... 10-2013-0150726

(51) Int. Cl.
*G09G 3/20* (2006.01)
*G09G 3/32* (2016.01)

(52) U.S. Cl.
CPC ..... *G09G 3/3266* (2013.01); *G09G 3/2022* (2013.01); *G09G 3/3233* (2013.01); *G09G 2300/0413* (2013.01); *G09G 2300/0842* (2013.01); *G09G 2310/0216* (2013.01); *G09G 2330/08* (2013.01); *G09G 2330/10* (2013.01)

(58) Field of Classification Search
None
See application file for complete search history.

(56) References Cited

U.S. PATENT DOCUMENTS

2006/0149493 A1 7/2006 Sambandan et al.
2008/0238327 A1 10/2008 Cho et al.
2011/0069061 A1* 3/2011 Nakamura ..... G09G 3/3225 345/214
2011/0080173 A1* 4/2011 Kim et al. ..... 324/403
2013/0176194 A1* 7/2013 Jin ..... G09G 3/3233 345/76

FOREIGN PATENT DOCUMENTS

KR 10-2008-0024009 A 3/2008
KR 10-2008-0100533 A 11/2008
KR 10-2010-0079095 A 7/2010

* cited by examiner

*Primary Examiner* — Joseph Haley
*Assistant Examiner* — Emily Frank
(74) *Attorney, Agent, or Firm* — Lewis Roca Rothgerber Christie LLP

(57) ABSTRACT

An organic light-emitting display apparatus for forming a frame by utilizing a plurality of subfields to display gradation. The organic light-emitting display apparatus includes a light-emitting pixel on a display area, a dummy pixel on a dummy area adjacent to the display area, and a repair line coupled to the dummy pixel. The light-emitting pixel is configured to emit light according to a logic level of a data signal applied during each of the subfields, and to adjust an emission time. The repair line is configured to couple the dummy pixel to a light-emitting element when the light-emitting element is separated from the light-emitting pixel, to provide a path to control a light emission of the light-emitting element according to a logic level of a dummy data signal applied to the dummy pixel.

20 Claims, 12 Drawing Sheets

ORGANIC LIGHT-EMITTING DISPLAY APPARATUS

CROSS-REFERENCE TO RELATED APPLICATION

This application claims priority to and the benefit of Korean Patent Application No. 10-2013-0150726, filed on Dec. 5, 2013, in the Korean Intellectual Property Office, the disclosure of which is incorporated herein in its entirety by reference.

BACKGROUND

1. Field

Aspects of embodiments of the present invention relate to an organic light-emitting display apparatus, and methods of repairing and driving the apparatus.

2. Description of the Related Art

When a pixel has a defect, the defective pixel may generate light irrespective of a scan signal and a data signal. A defective pixel that generates light in such a manner may be recognized as a bright spot (or luminescent spot) by an observer. Further, because the bright spot has high visibility, the bright spot may be readily observed by the observer.

Because an organic light-emitting display apparatus may have a complex pixel circuit and a complicated manufacturing process, a production yield may decrease due to a defective pixel as the organic light-emitting display apparatus becomes larger and has a higher resolution.

SUMMARY

Aspects of embodiments of the present invention are directed toward an organic light-emitting display apparatus capable of normally driving a defective pixel through a defective pixel repair to raise a production yield and improve quality degradation.

Additional aspects will be set forth in part in the description which follows and, in part, will be apparent from the description, or may be realized by practice of the presented embodiments.

According to an embodiment of the present invention, an organic light-emitting display apparatus for forming a frame by utilizing a plurality of subfields to display gradation includes: a light-emitting pixel on a display area, the light-emitting pixel configured to emit light according to a logic level of a data signal applied during each of the subfields, and adjusting an emission time; a dummy pixel on a dummy area adjacent to the display area; and a repair line coupled to the dummy pixel and configured to couple the dummy pixel to a light-emitting element when the light-emitting element is separated from the light-emitting pixel, to provide a path to control a light emission of the light-emitting element according to a logic level of a dummy data signal applied to the dummy pixel.

The dummy pixel may be coupled to a dummy scan line positioned on the dummy area, and the dummy scan line may be a scan line positioned before a first one of a plurality of scan lines or a scan line positioned after a last one of the plurality of scan lines on the display area.

The light-emitting pixel may include: a first thin film transistor configured to turn on when a scan signal is applied to a scan line coupled to the first thin film transistor, and to apply the data signal applied to a data line; a second thin film transistor configured to turn on according to a logic level of the data signal; a first capacitor configured to store a voltage corresponding to the data signal; and the light-emitting element.

The dummy pixel may include: a third thin film transistor configured to turn on when a dummy scan signal is applied to a dummy scan line coupled to the third thin film transistor, and to apply a dummy data signal applied to a data line; a fourth thin film transistor configured to turn on according to the logic level of the dummy data signal; and a second capacitor configured to store a voltage corresponding to the dummy data signal.

During a normal mode in which the data signal applied to the light-emitting pixel is used to emit light by the light-emitting element of the light-emitting pixel, the dummy data signal may be a data signal applied to a light-emitting pixel coupled to a first scan line on the display area or a data signal applied to a light-emitting pixel coupled to a last scan line on the display area. During a repair mode in which the dummy data signal applied to the dummy pixel is used to emit light by the light-emitting element of the light-emitting pixel, the dummy data signal may be a data signal applied or to be applied to the light-emitting pixel.

The light-emitting element may be separated from the light-emitting pixel and coupled to the repair line. The light-emitting element may be configured to emit light according to a driving voltage received from the fourth thin film transistor coupled to the repair line.

The dummy pixel may further include: an inverter coupled to the third thin film transistor, the inverter may be configured to invert the dummy data signal and to output an inverted signal; and a sixth thin film transistor coupled to a reset power supply configured to supply a reset signal, the sixth thin film transistor may be configured to turn on and off according to an output signal of the inverter.

The light-emitting element may be separated from the light-emitting pixel and coupled to the repair line. The light-emitting element may be configured to emit light according to a driving voltage received from the fourth thin film transistor coupled to the repair line, and to be reset to display black according to a reset signal received from the sixth thin film transistor coupled to the repair line.

The dummy pixel may further include an inverter coupled to the third thin film transistor, the inverter may be configured to invert the dummy data signal and to output an inverted signal.

The light-emitting element may be separated from the light-emitting pixel, and the light-emitting element, the inverter, and the fourth thin film transistor may each be coupled to the repair line. The light-emitting element may be configured to emit light according to a driving voltage received from the fourth thin film transistor and may be reset to display black according to a signal output from the inverter.

The dummy pixel may further include a diode-coupled fifth thin film transistor coupled to the fourth thin film transistor and to a second power supply configured to supply a second power supply voltage. The fifth thin film transistor may be configured to be separated from the dummy pixel when the light-emitting element is separated from the light-emitting pixel and coupled to the repair line.

The dummy pixel may further include: an inverter coupled to the third thin film transistor, the inverter may be configured to invert the dummy data signal, and to output an inverted signal; and a sixth thin film transistor configured to turn on according to an output signal of the inverter.

The fifth thin film transistor may be separated from the dummy pixel. The light-emitting element may be separated from the light-emitting pixel and coupled to the repair line.

The light-emitting element may be configured to emit light when a driving voltage is received from the fourth thin film transistor coupled to the repair line, and to be reset to display black when a reset signal is received from the sixth thin film transistor coupled to the repair line.

The dummy pixel may further include an inverter coupled to the third thin film transistor. The inverter may be configured to invert the dummy data signal and to output an inverted signal.

The fifth thin film transistor may be separated from the dummy pixel. The light-emitting element may be separated from the light-emitting pixel and coupled to the repair line. The light-emitting element may be configured to emit light when a driving voltage is received from the fourth thin film transistor coupled to the repair line, and to reset to display black according to the signal output from the inverter coupled to the repair line.

The dummy pixel may further include a dummy light-emitting element coupled to the fourth thin film transistor and a second power supply configured to supply a second power supply voltage. The dummy light-emitting element may be configured to be separated from the dummy pixel when the light-emitting element is separated from the light-emitting pixel and coupled to the repair line.

The dummy pixel may include a third thin film transistor and an inverter coupled to the third thin film transistor. The third thin film transistor may be configured to turn on according to a dummy scan signal applied to a dummy scan line to apply a dummy data signal applied to a data line. The inverter may be configured to invert the dummy data signal and to output an inverted signal.

The inverter may be coupled to the repair line, and the light-emitting element may be separated from the light-emitting pixel and coupled to the repair line. The light-emitting element may be configured to emit light according to the signal output by the inverter.

According to another embodiment of the present invention, an organic light-emitting display apparatus for forming a frame by using a plurality of subfields to display gradation includes: a light-emitting pixel coupled to a scan line and to a data line, the light-emitting pixel configured to emit light according to a logic level of a data signal applied during each of the subfields, and to adjust an emission time; a dummy pixel coupled to a dummy scan line and to the data line, the dummy pixel configured to receive a dummy data signal applied in each of the subfields; a repair line coupled to the dummy pixel and configured to couple the dummy pixel to a light-emitting element when the light-emitting element is separated from the light-emitting pixel, to provide a path to control a light emission of the light-emitting element according to a logic level of the dummy data signal; a scan driving unit configured to output a scan signal to the scan line; and a dummy scan driving unit configured to output a dummy scan signal to the dummy scan line.

The dummy scan line may be positioned on a dummy area adjacent to a display area and the dummy scan line may be a scan line positioned before a first one of a plurality of scan lines or a scan line positioned after a last one of the plurality of scan lines on the display area. The dummy data signal may be a data signal applied to a light-emitting pixel coupled to a first scan line or a data signal applied to a light-emitting pixel coupled to a last scan line on the display area during a normal mode in which the data signal applied to the light-emitting pixel is used to emit light by the light-emitting element of the light-emitting pixel. The dummy data signal may be a data signal applied or to be applied to the light-emitting pixel in a repair mode in which the dummy data signal applied to the dummy pixel is used to emit light by the light-emitting element of the light-emitting pixel.

BRIEF DESCRIPTION OF THE DRAWINGS

These and/or other aspects of the embodiments of the present invention will become apparent and appreciated by those skilled in the art from the following description of the embodiments, taken in conjunction with the accompanying drawings in which.

DETAILED DESCRIPTION

Figure 1:
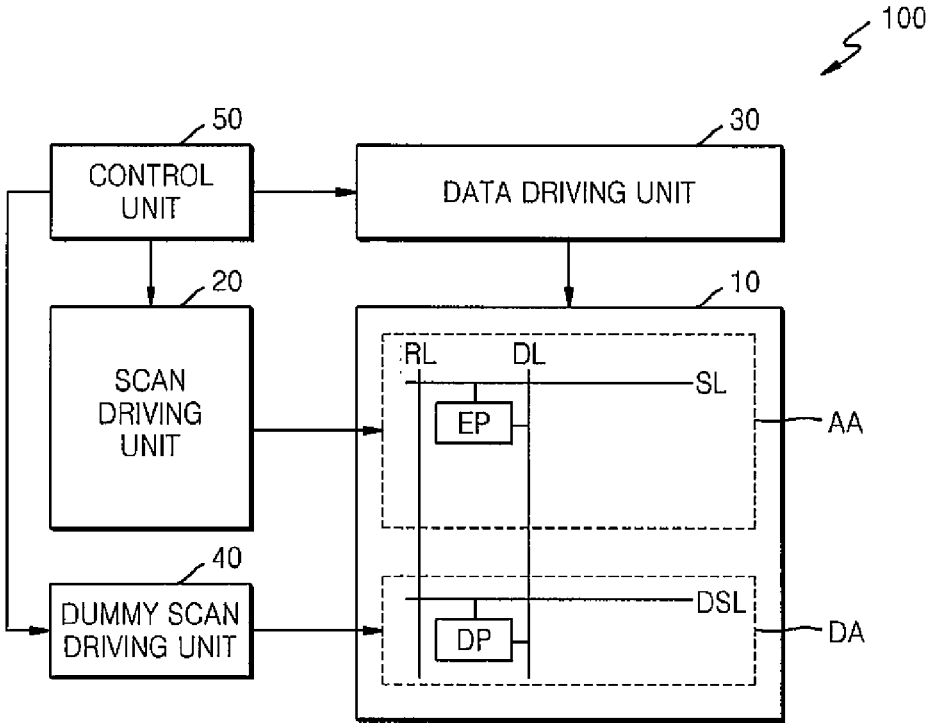
FIG. 1 is a schematic block diagram of a display apparatus according to an embodiment of the present invention.

The effects and features of the present invention, and implementation methods thereof, will be described through following embodiments with reference to the accompanying drawings. The present invention may, however, be embodied in various different forms and should not be construed as limited to the embodiments set forth herein.

Embodiments of the present invention are described below in detail with reference to the accompanying drawings. When referring to the drawings, the same or similar components are denoted by the same reference numerals, and repetitive descriptions thereof have been omitted.

In the following embodiments, the terms a first, a second, etc. are not used as limited meanings but used for the purpose of distinguishing one component from another component. In the following embodiments, the terms of a singular form may include plural forms unless specifically referred to in the contrary.

The meaning of "include", "has", "including", or "having" may specify a characteristic or a component, but may not exclude one or more characteristics or components.

As used herein, the term "and/or" includes any and all combinations of one or more of the associated listed items. Expressions such as "at least one of," when preceding a list of elements, modify the entire list of elements and do not modify the individual elements of the list.

FIG. 1 is a schematic block diagram of a display apparatus according to an embodiment of the present invention.

Referring to FIG. 1, a display apparatus 100, according to an embodiment of the present invention, includes a display panel 10 including a plurality of pixels, a scan driving unit 20, a data driving unit 30, a dummy scan driving unit 40, and a control unit 50. The scan driving unit 20, the data driving unit 30, the dummy scan driving unit 40, and the control unit 50 may be formed in separate integrated circuit (IC) chips or in one IC chip. The scan driving unit 20, the data driving unit 30, the dummy scan driving unit 40, and the control unit 50 may be installed directly on the display panel 10, installed on a flexible printed circuit film, attached to the display panel 10 in a tape carrier package (TCP) form, installed on a separate printed circuit board (PCB), or formed on the same substrate as the display panel 10.

The display panel 10 may include a display area AA and a dummy area DA. The dummy area DA may be a portion of a non-display area adjacent (e.g., near) the display area AA. The dummy area DA may be formed on at least one of the upper and lower areas of the display area AA. A plurality of light-emitting pixels (EP) coupled to (e.g., connected to) a scan line SL and to a data line DL is arranged on the display area AA. At least one dummy pixel DP coupled to a dummy scan line DSL and to a data line DL is arranged on the dummy area DA. The display panel may include a repair line RL in parallel to the data line DL for each column.

The repair line RL may couple (e.g., connect) a light-emitting element separated from a defective light-emitting pixel EP to a dummy pixel DP, and may provide a path to control a light emission from the light-emitting element of the light-emitting pixel EP according to a logic level of a dummy data signal applied to the dummy pixel DP.

Although in FIG. 1, a data line DL is illustrated as positioned (e.g., arranged) on the right side of the light-emitting pixel EP and the dummy pixel DP, and a repair line RL is illustrated as positioned on the left side thereof, embodiments of the present invention are not limited thereto, and the locations of the data line DL and the repair line RL may be reversed, or all of the data lines DL and repair lines RL may be arranged on the left side or on the right side of the light-emitting pixels EP and the dummy pixels DP. One or more repair lines RL may be formed for each pixel column. Also, according to a pixel design, the repair line RL may be formed in parallel to a scan line SL, and one or more repair lines RL may be formed for each pixel row.

The scan driving unit 20 may generate and supply scan signals to the display panel 10 at a set (e.g., predetermined) timing through a plurality of scan lines SL.

The data driving unit 30 may provide data signals, each data signal having any one of a first logic level and a second logic level, to each of a plurality of light-emitting pixels EP of the display panel 10 through a plurality of data lines DL. The first and second logic levels may be a high level and a low level, respectively. In another embodiment, the first and second logic levels may be a low level and a high level, respectively.

The data driving unit 30 may be configured to receive image data for each of the light-emitting pixels EP of a frame, extract gradation for each light-emitting pixel EP, and convert the extracted gradation into digital data having a set (e.g., predetermined) number of bits. The data driving unit 30 may provide each bit included in the digital data to each light-emitting pixel EP as a data signal for a corresponding subfield. A frame includes a plurality of subfields, and the display sustainment time of each of the subfields is determined according to a preset weight.

The display apparatus 100 may selectively emit light from a light-emitting element included in each light-emitting pixel EP, based on the logic level of the data signal provided from the data driving unit 30 for each subfield, and adjust the emission time of the light-emitting element in a frame to display gradation. When receiving a low-level data signal, each light-emitting pixel EP may emit light from the light-emitting element for a corresponding subfield section, and when receiving a high-level data signal, each light-emitting pixel EP may turn off the light-emitting element for a corresponding subfield section. In another embodiment, when receiving a high-level data signal, each light-emitting pixel EP may emit light from the light-emitting element for a corresponding subfield section, and when receiving a low-level data signal, each light-emitting pixel EP may turn off the light-emitting element for a corresponding subfield section.

The dummy scan driving unit 40 may apply a dummy scan signal to the dummy pixel DP at a set (e.g., predetermined) timing through the dummy scan line DSL. The dummy scan driving unit 40 may be implemented on an external flexible printed circuit board (FPCB) and may apply a dummy scan signal by using (e.g., utilizing) a pad coupled to the dummy scan line DSL. The dummy scan line DSL may be arranged before a first one of a plurality of scan lines SL or arranged after a last one of the plurality of scan lines SL.

Although FIG. 1 shows one dummy scan driving unit 40, embodiments of the present invention are not limited thereto. For example, dummy scan driving units 40 may be arranged on both sides of the dummy scan line DSL, and each dummy scan driving unit 40 may respectively apply a dummy scan signal to the dummy scan line DSL to prevent the voltage drop of the dummy scan signal from increasing due to a distance from the dummy scan driving unit 40. The dummy scan driving unit 40 may apply a dummy scan signal to a plurality of dummy areas at respective set (e.g., predetermined) timings.

When the dummy scan signal is applied to the dummy pixel DP by the dummy scan driving unit 40, the data driving unit 30 may apply a dummy data signal to the dummy pixel DP. When a data signal is applied to the light-emitting pixel EP, namely, in a normal driving mode, the data driving unit 30 may apply, to the dummy pixel DP, a data signal applied or to be applied to the light-emitting pixel EP coupled to a first or last scan line of the display area AA, as a dummy data signal. When a dummy data signal is applied to a repaired defective light-emitting pixel EP through the repair line RL, namely, in a repair driving mode, the data driving unit 30 may apply, to the dummy pixel DP, a data signal applied or to be applied to the light-emitting element of the repaired defective light-emitting pixel EP, as a dummy data signal.

The control unit 50 may generate a scan control signal, a data control signal, and a dummy control signal, and may apply the generated signals to the scan driving unit 20, the data driving unit 30, and the dummy scan driving unit 40, respectively. Thus, the scan driving unit 20 may apply a scan signal to each scan line SL at a set (e.g., predetermined) timing, and the data driving unit 30 may apply a data signal to each light-emitting pixel EP. The dummy scan driving unit 40 may apply a dummy scan signal to the dummy scan line DSL at a timing before a first scan line of the display area AA or after a last scan line of the display area AA, and the data driving unit 30 may apply a dummy data signal to the dummy pixel DP.

Figure 2:
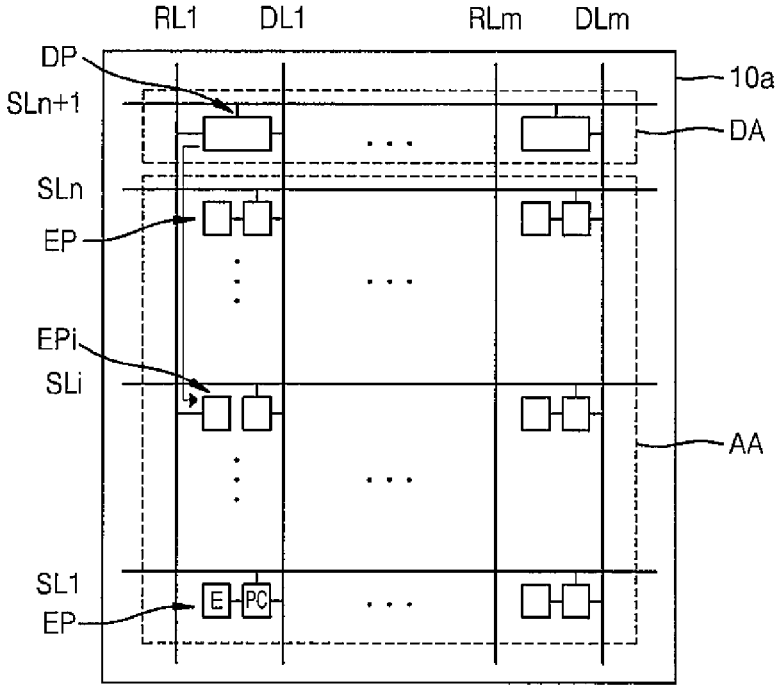
FIGS. 2 to 4 schematically represent methods of repairing a display panel according to the embodiment of FIG. 1.
Figure 3:
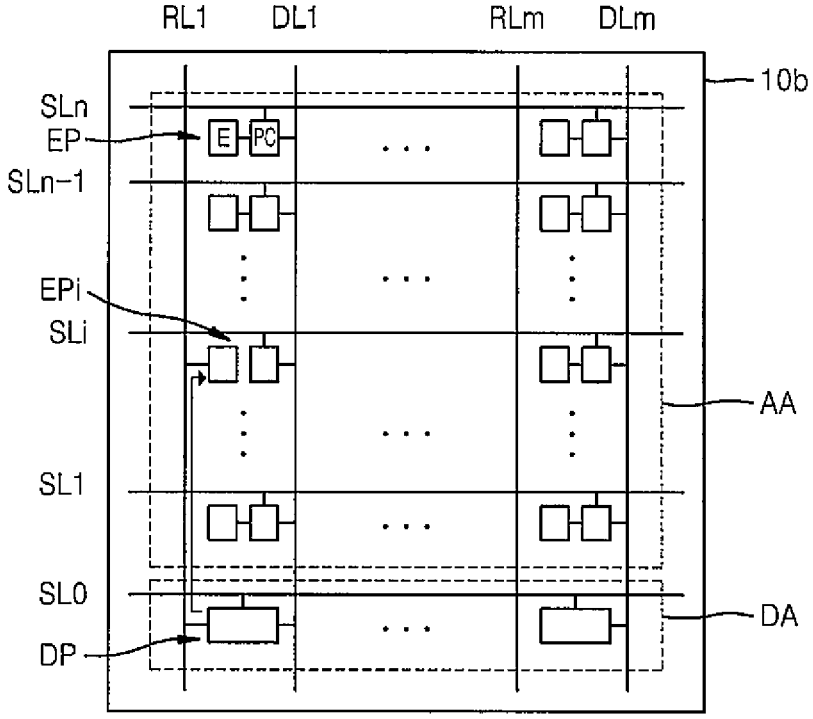
Figure 4:
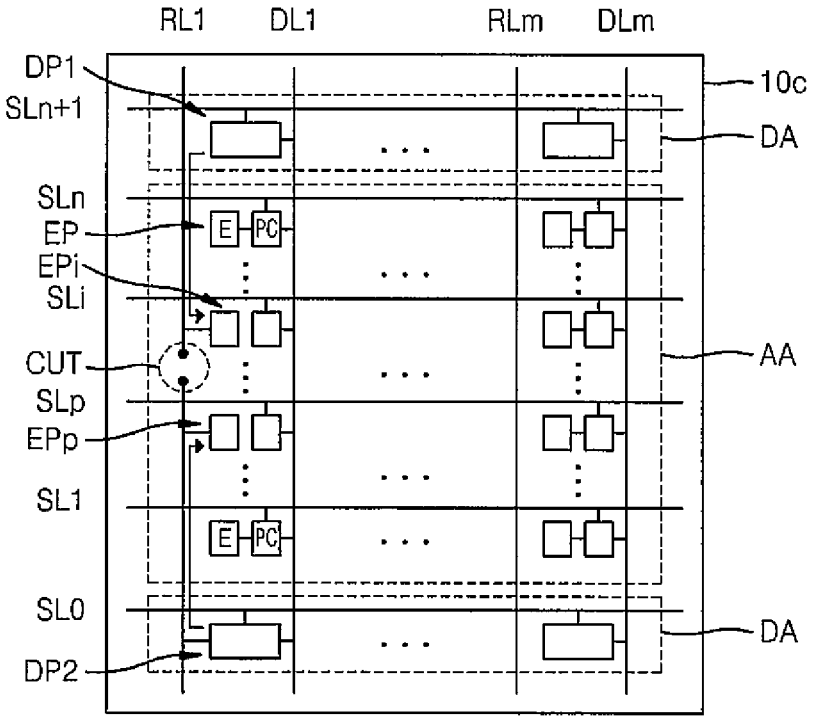

FIGS. 2 to 4 schematically represent methods of repairing a display panel 10 according to the embodiment of FIG. 1.

The dummy area DA may be positioned (e.g., formed) on at least one of the upper, lower, left and right areas of the display area AA. Thus, one or more dummy pixels DP may be positioned for each pixel column on at least one of the upper and lower areas of a pixel column, or may be positioned for each pixel row on at least one of the left and right areas of a pixel row. FIGS. 2 to 4 illustrate example embodiments where the dummy pixel DP is formed on the pixel column on the upper and lower dummy areas DA of the display area AA, but embodiments of the present invention are not limited thereto, and the methods shown in FIGS. 2 to 4 may be applied to embodiments where the dummy pixel DP is positioned on the pixel row on the left and right dummy areas DA of the display area AA.

Referring to FIG. 2, the display panel 10*a* includes a plurality of scan lines SL1 to SLn, a plurality of data lines DL1 to DLm, a plurality of repair lines RL1 to RLm, and a dummy scan line SLn+1. The display area AA includes a plurality of light-emitting pixels (EP) coupled to (e.g., connected to) the scan lines SL1 to SLn and to the data lines DL1 to DLm. The dummy area DA includes a plurality of dummy pixels DP coupled to the dummy scan line SLn+1 and to the data lines DL1 to DLm.

The dummy scan line SLn+1 may be an n+1th scan line after a last nth scan line SLn of the display area AA. In addition, the data lines DL1 to DLm and the repair lines RL1 to RLm may be formed for each pixel column on the display area AA and the dummy area DA.

When a light-emitting pixel EPi coupled to an ith scan line SLi of a first column is defective, a light-emitting element E of the defective light-emitting pixel EPi is separated from a pixel circuit (PC), and the separated light-emitting element E is coupled to the dummy pixel DP coupled to the dummy scan line SLn+1, through the repair line RL1.

Referring to FIG. 3, the display panel 10*b* includes the scan lines SL1 to SLn, the data lines DL1 to DLm, the repair lines RL1 to RLm, and a dummy scan line SL0. The display area AA includes the light-emitting pixels (EP) coupled to the scan lines SL1 to SLn and to the data lines DL1 to DLm. The dummy area DA includes the dummy pixels DP coupled to the dummy scan line SL0 and to the data lines DL1 to DLm.

The dummy scan line SL0 may be formed before a first scan line SL1 of the display area AA. In addition, the data lines DL1 to DLm and the repair lines RL1 to RLm may be formed for each pixel column on the display area AA and the dummy area DA.

When the light-emitting pixel EPi coupled to the ith scan line SLi of a first column is defective, the light-emitting element E of the defective light-emitting pixel EPi is separated from the pixel circuit (PC), and the separated light-emitting element E is coupled to the dummy pixel DP coupled to the dummy scan line SL0, through the repair line RL1.

Referring to FIG. 4, the display panel 10*c* includes the scan lines SL1 to SLn, the data lines DL1 to DLm, the repair lines RL1 to RLm, and first and second dummy scan lines SL0 and SLn+1. The display area AA includes the light-emitting pixels EP coupled to the scan lines SL1 to SLn and to the data lines DL1 to DLm. The dummy area DA includes a plurality of dummy pixels DP1 and DP2 coupled to the first and second dummy scan lines SL0 and SLn+1 and to the data lines DL1 to DLm.

The first dummy scan line SL0 may be formed before a first scan line SL1 of the display area AA, and the second dummy scan line SLn+1 may be formed after a last nth scan line SLn of the display area AA. In addition, the data lines DL1 to DLm and the repair lines RL1 to RLm may be formed for each pixel column on the display area AA and the dummy area DA.

When the light-emitting pixel EPi coupled to the ith scan line SLi of a first column and a light-emitting pixel EPp coupled to a pth scan line SLp of a pth row are defective, the repair line RL1 is cut between the defective light-emitting pixels EPi and EPp. Each light element E of the defective light-emitting pixels EPi and EPp is separated from the pixel circuit (PC). The separated light-emitting element E of the defective light-emitting pixel EPi is coupled to the first dummy pixel DP1, which is coupled to the second dummy scan line SLn+1, through the repair line RL1. The separated light-emitting element E of the defective light-emitting pixel EPp is coupled to the second dummy pixel DP2, which is coupled to the first dummy scan line SL0, through the repair line RL1.

Although in FIGS. 2 to 4, one dummy pixel DP is shown for each pixel column on each dummy area DA, embodiments of the present invention are not limited thereto, and more than one dummy pixels DP may be formed for each pixel column on each dummy area DA.

Figure 5:
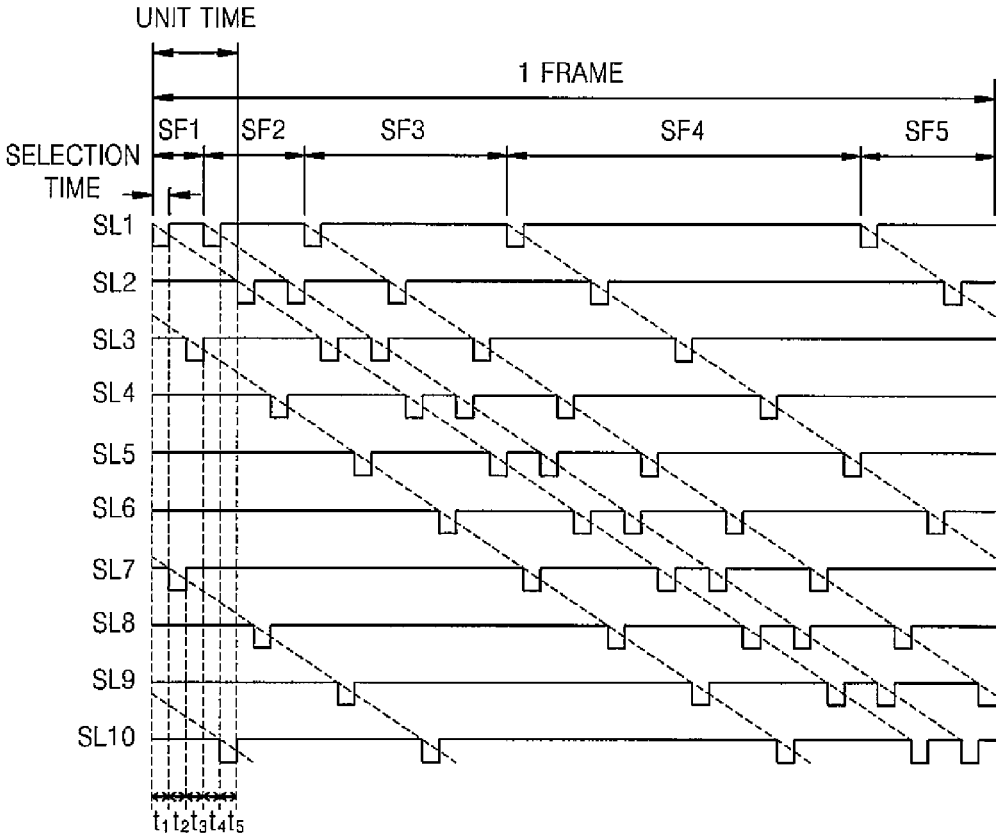
FIGS. 5 and 6 are timing diagrams for a method of driving a display panel according to the embodiment of FIG. 1.
Figure 6:
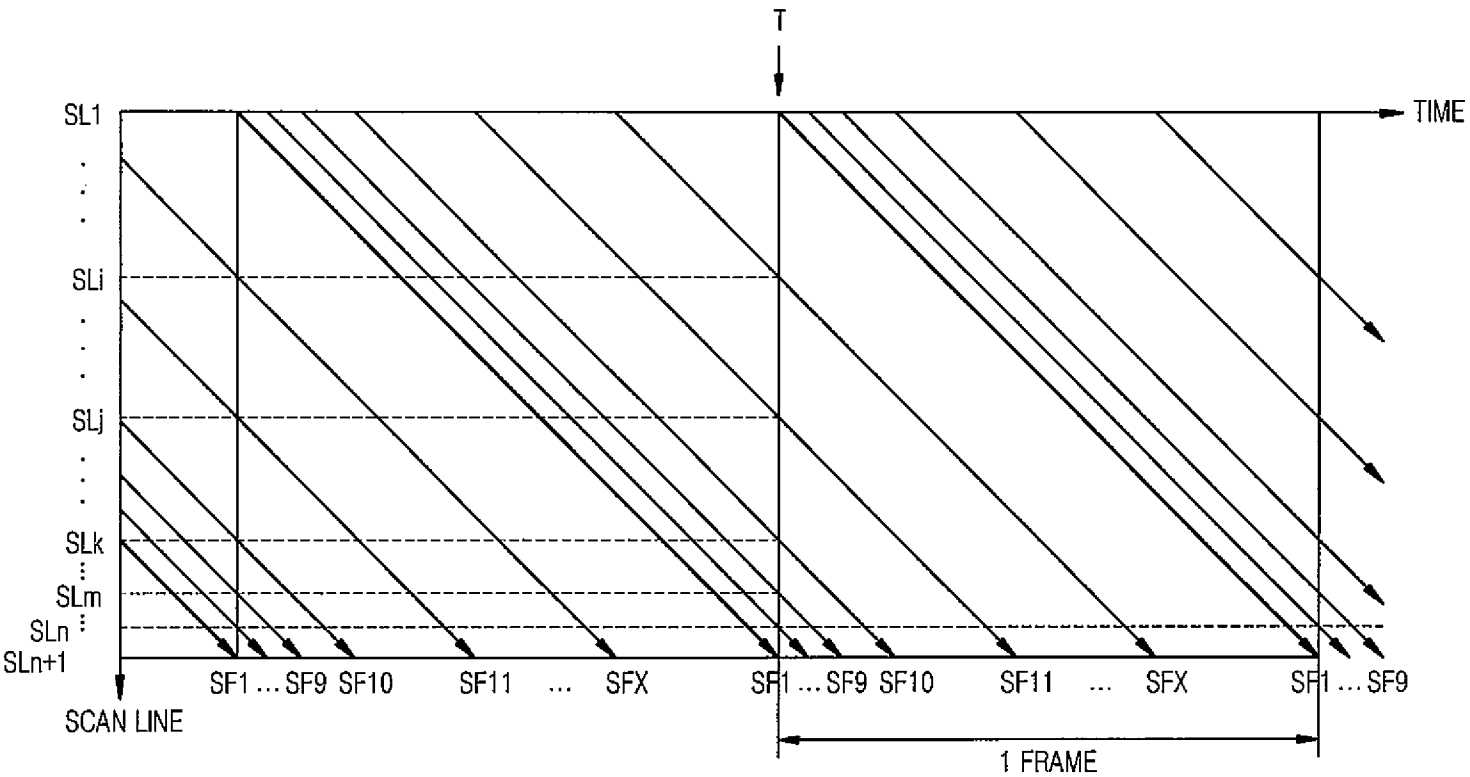

FIGS. 5 and 6 are timing diagrams for explaining a method of driving a display panel according to the embodiment of FIG. 1.

FIG. 5 shows an example where first to tenth scan lines (SL1 to SL10) are controlled. Referring to FIG. 5, a frame includes five subfields, namely, first to fifth subfields SF1 to SF5 to display gradation by five pieces of bit data, namely, first to fifth bit data. One unit time includes five selection times. The length of the display sustainment time of each bit data may be 3:6:12:21:8, and the sum of the display sustainment times of five pieces of bit data becomes 50 (e.g., =3+6+12+21+8) selection time. The selection timing of each scan line may be delayed by one unit time from the selection timing of a previous scan line for each subfield.

The five selection times within one unit time are time-divided so that the scan driving unit 20 selects a scan line at a time. For example, within a first unit time, a first scan line SL1, a seventh scan line SL7, a third scan line SL3, a first scan line SL1, and a tenth scan line SL10 are sequentially selected during a first selection time, a second selection time, a third selection time, a fourth selection time, and a fifth selection time, respectively; and a first bit data, a fourth bit data, a fifth bit data, a second bit data, and a third bit data are applied to each light-emitting pixel EP.

In this example, when the tenth scan line SL10 is a dummy scan line, and the display panel 10 drives normally without a repair, a bit data applied to a light-emitting pixel EP coupled to a first scan line SL1 or a ninth scan line SL9 of the same pixel column, may be applied to the dummy pixel DP of each pixel column at a timing when the tenth scan line SL10 is selected.

When the dummy pixel DP coupled to the tenth scan line SL10 is used (e.g., utilized) for a repair, a bit data applied to a repaired light-emitting pixel EP of the same pixel column is applied to the dummy pixel DP at a timing when the tenth scan line SL10 is selected.

FIG. 6 shows an example where the first to the n+1th scan lines SL1 to SLn+1 are controlled. Referring to FIG. 6, a frame includes first to Xth subfields SF1 to SFX, and gradation is presented by X pieces of bit data, namely, first to Xth bit data. One unit time includes X selection times. The selection timing of each scan line is delayed by one unit time than the selection timing of a previous scan line for each subfield.

The X selection times within one unit time are time-divided so that the scan driving unit 20 selects a scan line at a time. Also, the scan driving unit 20 may be set so that scan lines are selected by using (e.g., utilizing) a time division technique even within one selection time at which a plurality of scan lines SL1, SLi, SLj, SLk, SLm, SLn, and SLn+1, such as a time T.

In this example, when a last n+1th scan line SLn+1 is a dummy scan line, and the display panel 10 drives normally without a repair, a bit data applied to a light-emitting pixel EP coupled to a first scan line SL1 or a nth scan line SLn of the same pixel column, may be applied to the dummy pixel DP at a timing when the n+1th scan line SLn+1 is selected.

Figure 7:
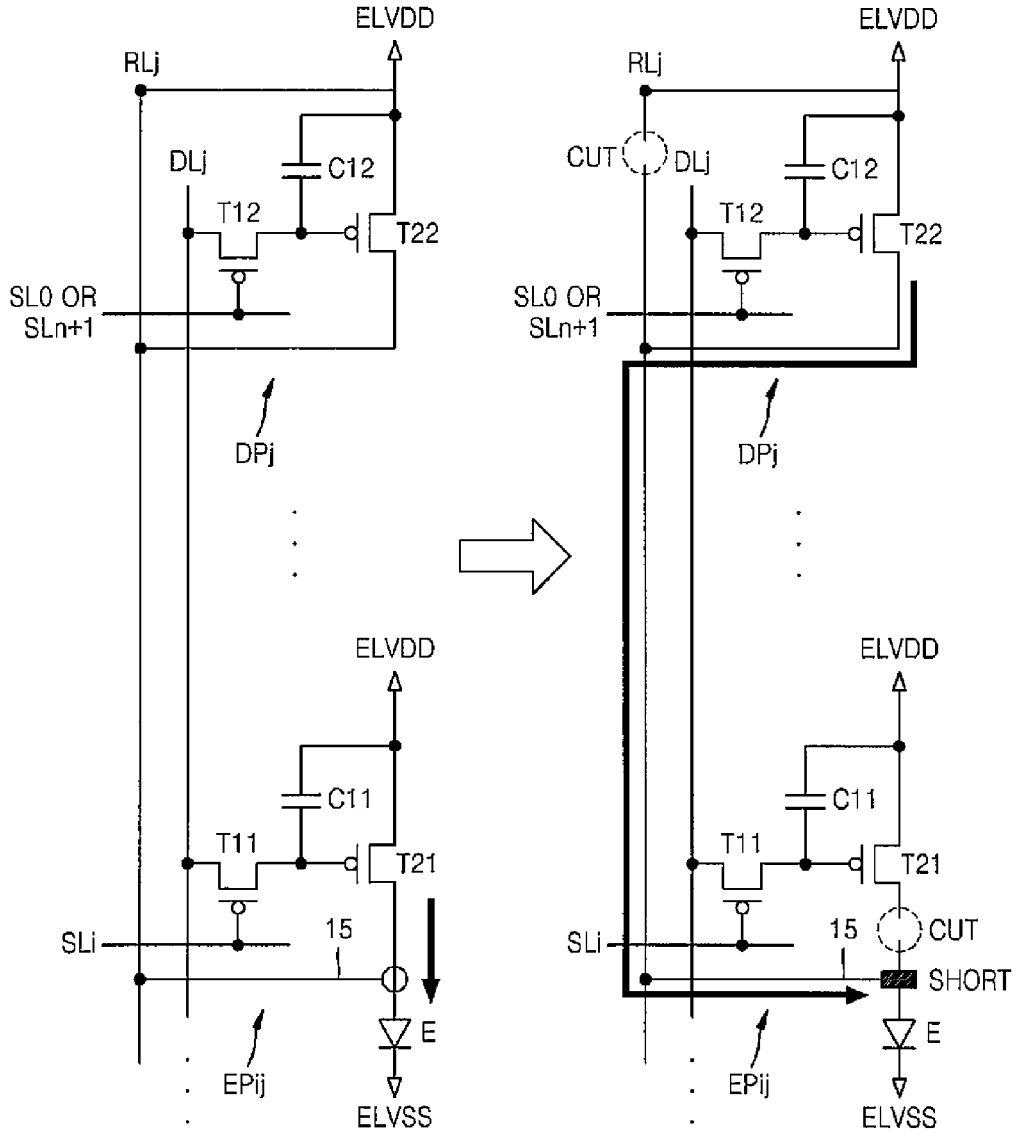
FIGS. 7 to 14 depict methods of repairing a defective pixel according to example embodiments of the present invention.

FIG. 7 depicts a method of repairing a defective pixel by using (e.g., utilizing) a repair line according to an embodiment of the present invention.

The circuit on the left-hand side in FIG. 7 shows a dummy pixel DP and a light-emitting pixel EP positioned in the same pixel column before a repair is performed. The circuit on the right-hand side in FIG. 7 shows the dummy pixel DP and the light-emitting pixel EP positioned in the same pixel column after a repair is performed. The light-emitting pixel EP may include an organic light-emitting diode OLED as a light-emitting element E. In FIG. 7, a light-emitting pixel EPij coupled to a jth pixel column and to an ith pixel row, and a dummy pixel DPj coupled to a jth pixel column and to a zeroth or n+1th pixel row are shown as an example.

Referring to FIG. 7, a repair line RLj is arranged (e.g., positioned) next to a data line DLj along a pixel column, and the repair line RLj is coupled to a first power supply configured to supply a first power supply voltage ELVDD.

The light-emitting pixel EPij may include a pixel circuit and a light-emitting element E coupled to (e.g., connected to) the pixel circuit. The pixel circuit may include two transistors T11 and T21, and one capacitor C11. The light-emitting element may be an OLED that includes a first electrode, a second electrode facing the first electrode, and an emission layer between the first electrode and the second electrode. The first electrode and the second electrode may be an anode and a cathode, respectively.

In the case of a first transistor T11, a gate electrode of the first transistor T11 may be coupled to (e.g., connected to) a scan line SLi, a first electrode of the first transistor T11 may be coupled to the data line DLj, and a second electrode of the first transistor T11 may be coupled to a gate electrode of the second transistor T21. In the case of the second transistor T21, the gate electrode of the second transistor T21 may be coupled to the second electrode of the first transistor T11, a first electrode of the second transistor T21 may be coupled to the first power supply to receive the first power supply voltage ELVDD, and a second electrode of the second transistor T21 may be coupled to an anode of the light-emitting element E. In the case of the first capacitor C11, a first electrode of the first capacitor C11 may be coupled to the second electrode of the first transistor T11 and to the gate electrode of the second transistor T21, and a second electrode of the first capacitor C11 may receive the first power supply voltage ELVDD from the first power supply. In the case of the light-emitting element E, the anode of the light-emitting element E may be coupled to the second electrode of the second transistor T21, and a cathode of the light-emitting element E may be coupled to a second power supply to receive a second power supply voltage ELVSS. The first power supply voltage ELVDD may be at a high-level voltage, and the second power supply voltage ELVSS may be at a lower-level voltage lower than that of the first power supply voltage ELVDD or may be at a ground voltage.

The dummy pixel DPj may include a pixel circuit that includes two transistors T12 and T22, and one capacitor C12.

In the case of a third transistor T12, a gate electrode of the third transistor T12 may be coupled to (e.g., connected to) a dummy scan line SL0 or SLn+1. A first electrode of the third transistor T12 may be coupled to the data line DLj, and a second electrode of the third transistor T12 may be coupled to a gate electrode of a fourth transistor T22. In the case of the fourth transistor T22, the gate electrode of the fourth transistor T22 may be coupled to the second electrode of the third transistor T12, a first electrode of the fourth transistor T22 may be coupled to the first power supply to receive the first power supply voltage ELVDD, and a second electrode of the fourth transistor T22 may be coupled to the repair line RLj. In the case of a second capacitor C12, a first electrode of the second capacitor C12 may be coupled to the second electrode of the third transistor T12 and to the gate electrode of the fourth transistor T22. A second electrode of the second capacitor C12 may be coupled to the first power supply to receive the first power supply voltage ELVDD. Because the repair line RLj is coupled to the first power supply, and the voltage Vds between the source and drain of the fourth transistor T22 is 0 V, the fourth transistor T22 has no degradation even when coupled to the repair line RLj.

In the following, a driving method of a light-emitting pixel EPij that is normally driven as a normal pixel according to an embodiment of the present invention is described.

When a scan signal Si is supplied from the scan line SLi, the first transistor T11 of the light-emitting pixel EPij is turned on to apply a data signal Dij supplied from the data line DLj. A voltage corresponding to (e.g., according to) the data signal Dij is charged in the first capacitor C11, and the second transistor T21 is turned on or off according to a logic level of the data signal Dij. When the second transistor T21 is turned on, the second transistor T21 outputs a driving current according to the first power supply voltage ELVDD, and thus the first power supply voltage ELVDD is applied to the anode of the light-emitting element E as a driving voltage, and the light-emitting element E emits light.

When a dummy scan signal RRSi is supplied from the dummy scan line SL0 or SLn+1, the third transistor T12 of the dummy pixel DPj is turned on to apply a dummy data signal DDj supplied from the data line DLj. A voltage corresponding to the dummy data signal DDj is charged in the second capacitor C12, and the fourth transistor T22 is turned on or off according to a logic level of the dummy data signal DDj. The dummy data signal DDj may be a data signal D1*j* applied to a light-emitting pixel EP1*j* coupled to a first scan line SL1 in the same pixel column, or a data signal Dnj applied to a light-emitting pixel EPnj coupled to an nth scan line SLn.

In the following, a repair method according to an embodiment of the present invention is described when the light-emitting pixel EPij has a defect due to a pixel circuit defect of the light-emitting pixel EPij.

The light-emitting element E of the defective light-emitting pixel EPij is separated from the defective light-emitting pixel EPij and coupled to (e.g., connected to) the repair line RLj. For example, the light-emitting pixel EPij may include a connection wire 15. One end of the connection wire 15 may be coupled to the repair line RLj, and the other end of the connection wire 15 may overlap with a portion of the anode of the light-emitting element E or with a wire coupled to the anode of the light-emitting element E. The other end of the connection wire 15 may be insulated by an insulating layer.

When a repair is performed, a laser beam may be emitted to cut an area where the anode of the light-emitting element E is coupled to the second electrode of the second transistor T21. In addition, a laser beam may be emitted to an area where the connection wire 15 overlaps with a portion of the anode, or with a wire coupled to the anode, to destroy the insulating layer insulating the other end of the connection wire 15, to short the portion of the anode or the wire coupled to the anode and the connection wire 15. Thus, the light-emitting element E may be coupled to (e.g., connected to) the repair line RLj. The connection wire 15 may be a wire extended from the repair line RLj or a wire that is formed of a separate conductive material and coupled to the repair line RLj.

In addition, the repair line RLj is separated from the first power supply. For example, an area where the repair line RLj is coupled to the first power supply may be cut by emitting a laser beam to the area.

In the following, a driving method of a defective light-emitting pixel EPij that has been repaired by the dummy pixel DPj according to an embodiment of the present invention is described.

When the dummy scan signal RRSi is supplied from the dummy scan line SL0 or SLn+1, the third transistor T12 of the dummy pixel DPj is turned on to apply the dummy data signal DDj supplied from the data line DLj. A voltage corresponding to the dummy data signal DDj is charged in the second capacitor C12, and the fourth transistor T22 is turned on or off according to the logic level of the dummy data signal DDj. The dummy data signal DDj is a data signal Dij applied or to be applied to a pixel circuit of the defective light-emitting pixel EPij coupled to the repair line RLj. When the fourth transistor T22 is turned on, the fourth transistor T22 of the dummy pixel DPj applies the first power supply voltage ELVDD to the repair line RLj. A high-level signal of the first power supply voltage ELVDD is applied to the anode of the light-emitting element E of the defective light-emitting pixel EPij through the repair line RLj, and the light-emitting element E emits light. When the fourth transistor T22 of the dummy pixel DPj is turned off, the light-emitting element E stops emitting light and displays black.

Figure 8:
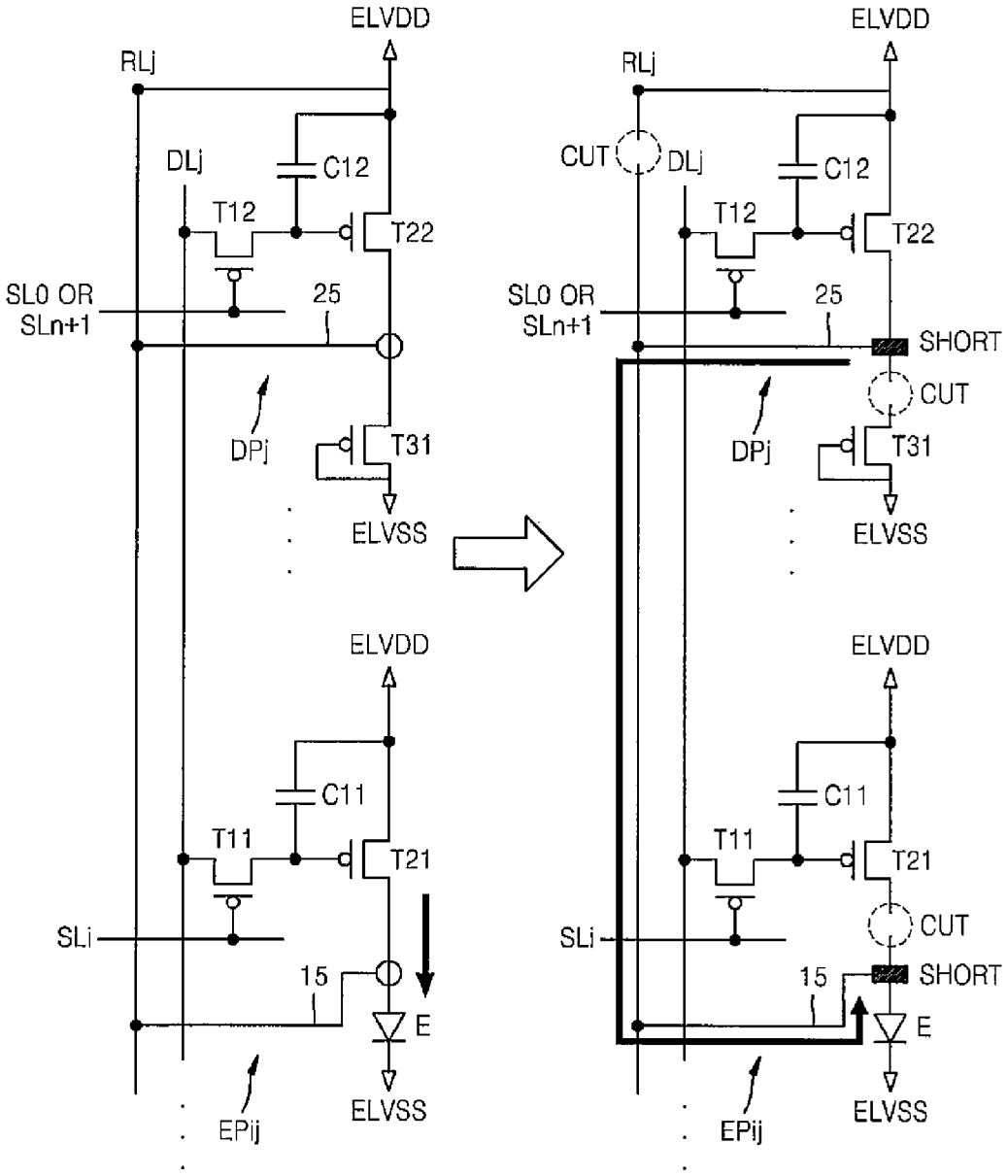

FIG. 8 depicts a method of repairing a defective pixel by using (e.g., utilizing) a repair line according to an embodiment of the present invention.

The circuit on the left-hand side in FIG. 8 shows a dummy pixel DP and a light-emitting pixel EP positioned in the same pixel column before a repair is performed. The circuit on the right-hand side in FIG. 8 shows a dummy pixel DP and a light-emitting pixel EP positioned in the same pixel column after a repair is performed.

In FIG. 8, a light-emitting pixel EPij coupled to a jth pixel column and to an ith pixel row, and a dummy pixel DPj coupled to a jth pixel column and to a zeroth or n+1th pixel row are shown as an example. Compared to the embodiment of FIG. 7, the dummy pixel DPj in the embodiment of FIG. 8 further includes a diode-coupled fifth transistor T31. In the following description, content that has been described with reference to the embodiment of FIG. 7 that is substantially similar to the embodiment of FIG. 8 has been omitted.

Referring to FIG. 8, a repair line RLj is arranged (e.g., positioned) next to a data line DLj along a pixel column, and the repair line RLj is coupled to a first power supply configured to supply a first power supply voltage ELVDD.

The light-emitting pixel EPij may include a pixel circuit and a light-emitting element E coupled to (e.g., connected to) the pixel circuit. The pixel circuit may include two transistors T11 and T21, and one capacitor C11.

The dummy pixel DPj may include a pixel circuit that includes three transistors T12, T22 and T31, and one capacitor C12.

In the case of a third transistor T12 of the dummy pixel DPj, a gate electrode of the third transistor T12 may be coupled to (e.g., connected to) a dummy scan line SL0 or SLn+1. A first electrode of the third transistor T12 may be coupled to the data line DLj, and a second electrode of the third transistor T12 may be coupled to a gate electrode of a fourth transistor T22. In the case of the fourth transistor T22, the gate electrode of the fourth transistor T22 may be coupled to the second electrode of the third transistor T12, a first electrode of the fourth transistor T22 may be coupled to the first power supply to receive the first power supply voltage ELVDD, and a second electrode of the fourth transistor T22 may be coupled to a first electrode of a fifth transistor T31. In the case of the fifth transistor T31, a gate electrode and a second electrode of the fifth transistor T31 may be coupled to a second power supply to receive a second power supply voltage ELVSS. The first electrode of the fifth transistor T31 may be coupled to the second electrode of the fourth transistor T22. In the case of a second capacitor C12, a first electrode of the second capacitor C12 may be coupled to the second electrode of the third transistor T12 and to the gate electrode of the fourth transistor T22. A second electrode of the second capacitor C12 may be coupled to the first power supply to receive the first power supply voltage ELVDD. The fifth transistor T31 may be diode-coupled by the second power supply voltage ELVSS, and thus, may function as a parasitic capacitor that is generated by the anode and cathode of the light-emitting element E of the light-emitting pixel EPij.

In the following, a repair method according to an embodiment of the present invention is described when the light-emitting pixel EPij has a defect due to a pixel circuit defect of the light-emitting pixel EPij.

The light-emitting element E of the defective light-emitting pixel EPij is separated from the defective light-emitting pixel EPij and coupled to (e.g., connected to) the repair line RLj. For example, the light-emitting pixel EPij may include a connection wire 15. One end of the connection wire 15 may be coupled to the repair line RLj, and the other end of the connection wire 15 may overlap with a portion of the anode of the light-emitting element E or with a wire coupled to the anode of the light-emitting element E. The other end of the connection wire 15 may be insulated by an insulating layer.

When a repair is performed, a laser beam may be emitted to cut an area where the anode of the light-emitting element E is coupled to (e.g., connected to) the second electrode of the second transistor T21. In addition, a laser beam may be emitted to an area where the connection wire 15 overlaps with a portion of the anode, or with a wire coupled to the anode, to destroy the insulating layer insulating the other end of the connection wire 15, to short the anode and the connection wire 15. Thus, the light-emitting element E may be coupled to the repair line RLj. The connection wire 15 may be a wire extended from the repair line RLj or a wire that is formed of a separate conductive material and coupled to the repair line RLj.

In addition, the fifth transistor T31 of the dummy pixel DPj may be separated from the dummy pixel DPj. The dummy pixel DPj may be coupled to the repair line RLj, and the repair line RLj may be separated from the first power supply. For example, the dummy pixel DPj may include a connection wire 25. One end of the connection wire 25 may be coupled to the repair line RLj, and the other end of the connection wire 25 may overlap with the second electrode of the fourth transistor T22 and may be insulated by an insulating layer.

When a repair is performed, a laser beam may be emitted to cut an area where the repair line RLj is coupled to the first power supply. In addition, the laser beam may be emitted to cut an area where the fourth transistor T22 is coupled to the fifth transistor T31. The laser beam may be emitted to an area where the connection wire 25 overlaps with the second electrode of the fourth transistor T22 to destroy the insulating layer, and to short the connection wire 25 and the second electrode of the fourth transistor T22. Thus, the dummy pixel DPj may be coupled to (e.g., connected to) the repair line RLj.

In the following, a driving method of a defective light-emitting pixel EPij that has been repaired by the dummy pixel DPj according to an embodiment of the present invention is described.

When a dummy scan signal RRSi is supplied from a dummy scan line SL0 or SLn+1, the third transistor T12 of the dummy pixel DPj is turned on to apply a dummy data signal DDj supplied from a data line DLj. A voltage corresponding to the dummy data signal DDj is charged in the second capacitor C12, and the fourth transistor T22 is turned on or off according to the logic level of the dummy data signal DDj. The dummy data signal DDj is a data signal Dij applied or to be applied to a pixel circuit of the defective light-emitting pixel EPij coupled to the repair line RLj. When the fourth transistor T22 is turned on, the fourth transistor T22 of the dummy pixel DPj outputs a driving current according to the first power supply voltage ELVDD and thus applies the first power supply voltage ELVDD to the repair line RLj. A high-level signal of the first power supply voltage ELVDD is applied to the anode of the light-emitting element E of the defective light-emitting pixel EPij through the repair line RLj, and the light-emitting element E emits light. When the fourth transistor T22 of the dummy pixel DPj is turned off, the light-emitting element E stops emitting light and displays black.

Figure 9:
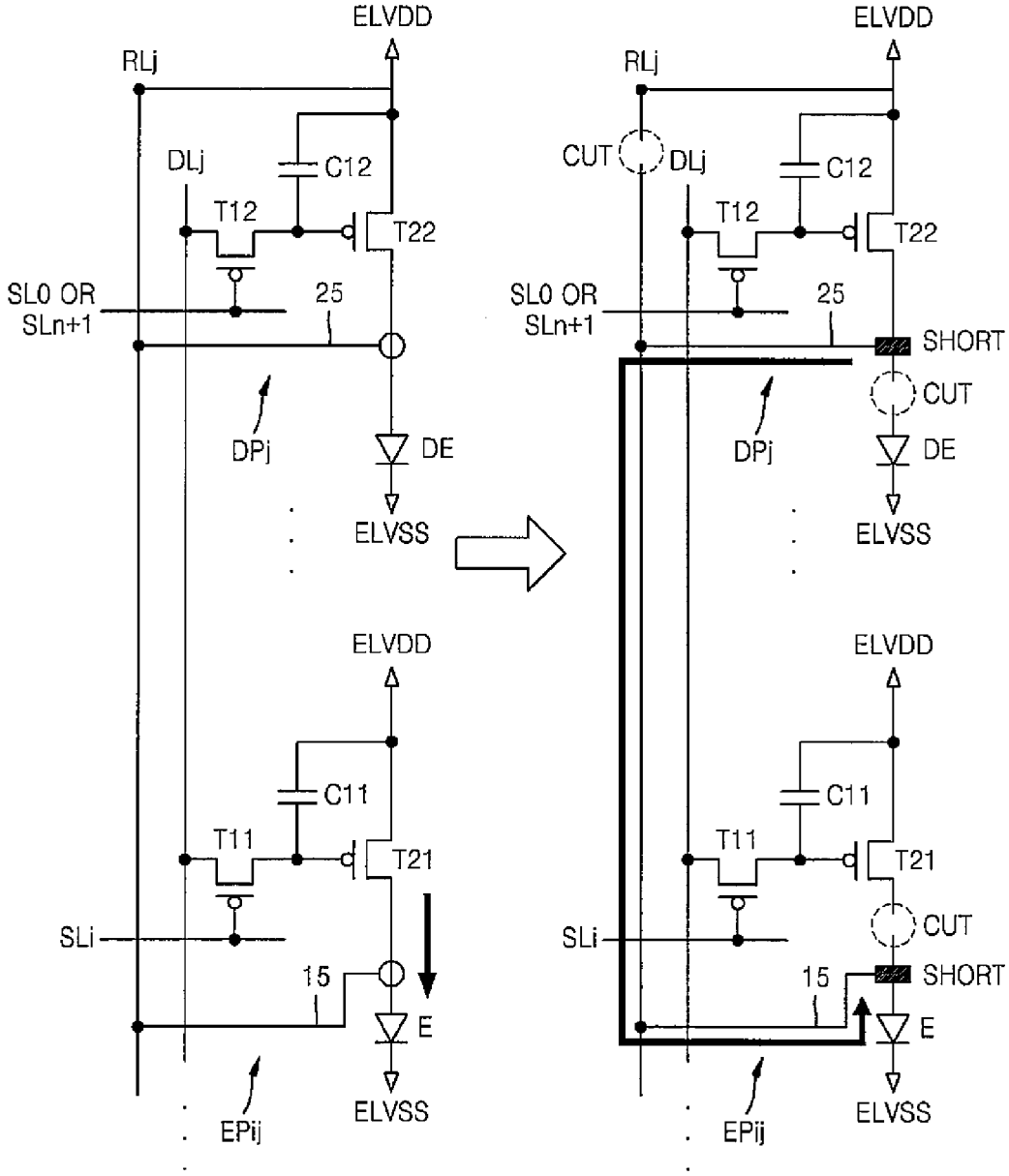

FIG. 9 depicts a method of repairing a defective pixel by using (e.g., utilizing) a repair line according to an embodiment of the present invention.

Compared to the embodiment of FIG. 7, a dummy pixel DPj in the embodiment of FIG. 9 further includes a dummy light-emitting element IDE. Because the embodiment of FIG. 9 includes the dummy light-emitting element DE in place of the diode-coupled fifth transistor T32 of FIG. 8, and the other components are substantially similar to the embodiment of FIG. 8, the detailed description thereof have been omitted.

In the case of the dummy light-emitting element DE, an anode of the dummy light-emitting element DE may be coupled to the second electrode of the fourth transistor T22, and a cathode of the dummy light-emitting element DE may be coupled to a second power supply. The dummy light-emitting element DE may be configured to not emit light, and may function as a circuit element. For example, the dummy light-emitting element DE may function as a capacitor.

When a repair is performed, the dummy light-emitting element DE may be separated from the fourth transistor T22, and thus, from the dummy pixel DPj.

Figure 10:
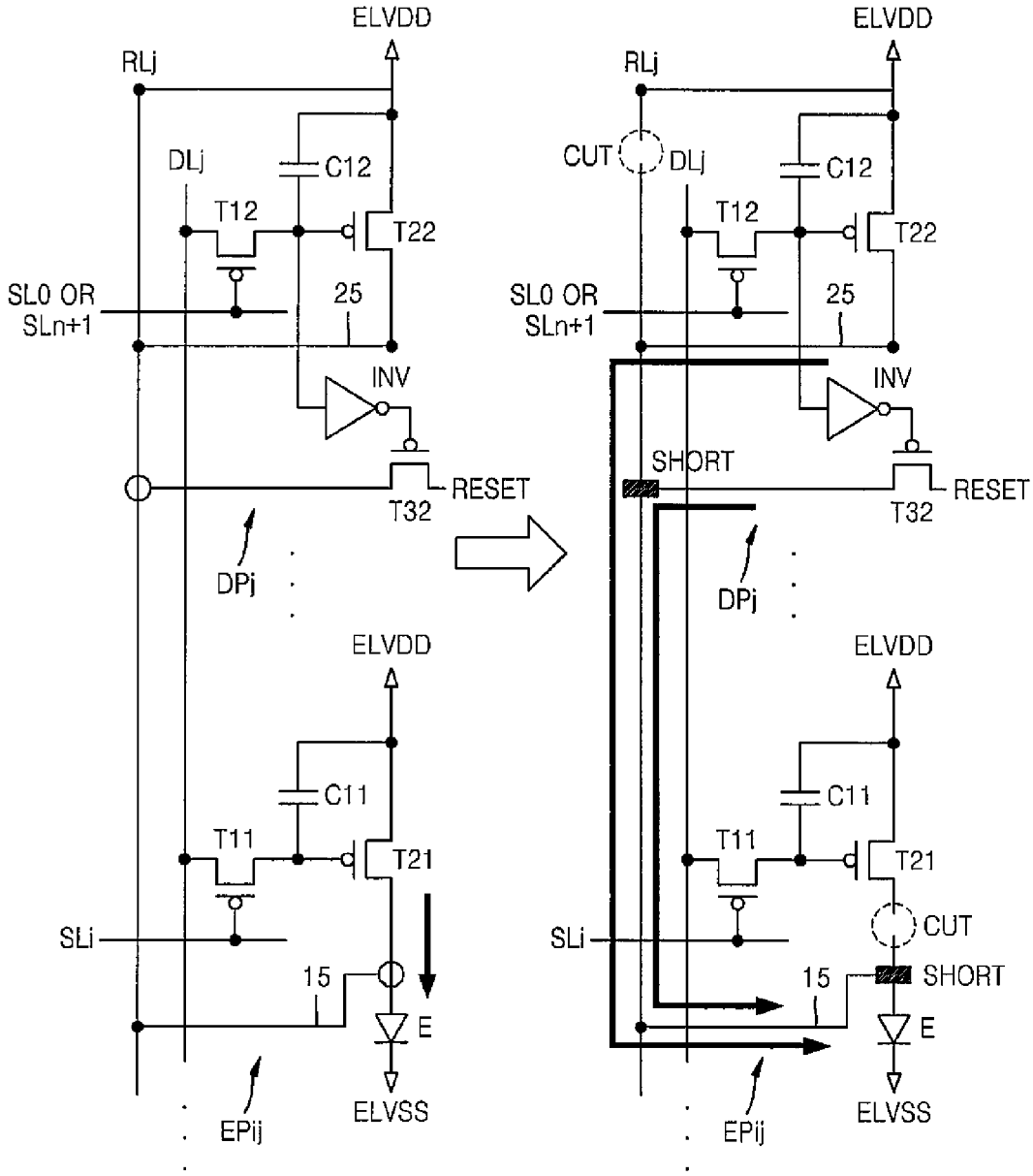

FIG. 10 depicts a method of repairing a defective pixel by using (e.g., utilizing) a repair line according to an embodiment of the present invention.

The circuit on the left-hand side in FIG. 10 shows a dummy pixel DP and a light-emitting pixel EP positioned in the same pixel column before a repair is performed. The circuit on the right-hand side in FIG. 10 shows a dummy pixel DP and a light-emitting pixel EP positioned in the same pixel column after a repair is performed.

In FIG. 10, a light-emitting pixel EPij coupled to (e.g., connected to) a jth pixel column and to an ith pixel row, and a dummy pixel DPj coupled to a jth pixel column and to a zeroth or n+1th pixel row are shown as an example. Compared to the embodiment of FIG. 7, the dummy pixel DPj further includes an inverter INV and a sixth transistor T32. In the following description, content that has been described with reference to the embodiment of FIG. 7 that is substantially similar to the embodiment of FIG. 10 has been omitted.

Referring to FIG. 10, a repair line RLj is arranged (e.g., positioned) next to a data line DLj along a pixel column, and the repair line RLj is coupled to a first power supply configured to supply a first power supply voltage ELVDD.

The light-emitting pixel EPij may include a pixel circuit and a light-emitting element E coupled to the pixel circuit. The pixel circuit may include two transistors T11 and T21, and one capacitor C11.

The dummy pixel DPj may include a pixel circuit that includes three transistors T12, T22 and T32, and one capacitor C12.

In the case of a third transistor T12 of the dummy pixel DPj, a gate electrode of the third transistor T12 may be coupled to a dummy scan line SL0 or SLn+1. A first electrode of the third transistor T12 may be coupled to a data line DLj, and a second electrode of the third transistor T12 may be coupled to a gate electrode of the fourth transistor T22. In the case of the fourth transistor T22, a gate electrode of the fourth transistor T22 may be coupled to the second electrode of the third transistor T12, a first electrode of the fourth transistor T22 may be coupled to the first power supply to receive the first power supply voltage ELVDD, and a second electrode of the fourth transistor T22 may be coupled to the repair line RLj. In the case of a second capacitor C12, a first electrode of the second capacitor C12 may be coupled to the second electrode of the third transistor T12 and to the gate electrode of the fourth transistor T22. A second electrode of the second capacitor C12 may be coupled to the first power supply to receive the first power supply voltage ELVDD. In the case of the inverter INV, which inverts and outputs an input signal, an input of the inverter INV may be coupled to (e.g., connected to) the second electrode of the third transistor T12, and an output of the inverter INV may be coupled to a gate electrode of a sixth transistor T32. In the case of the sixth transistor T32, the gate electrode of the sixth transistor T32 may be coupled to the output of the inverter INV, a first electrode of the sixth transistor T32 may be coupled to a reset power supply configured to apply a reset signal RESET, and a second electrode of the sixth transistor T32 may be in a floating state. The inverter INV and the sixth transistor T32 may apply the reset signal RESET to an anode of the light-emitting element E, while the light-emitting element E of a repaired light-emitting pixel EP displays black. A power supply of the inverter INV may use (e.g., utilize) the high-level and low-level signals of the dummy data signal Dij. The first power supply voltage ELVDD may be utilized as the high-level signal of the inverter INV.

Because the on or off timing of the light-emitting element E of the repaired light-emitting pixel EP may be secured by applying the inverter INV to the dummy pixel DP, according to an embodiment of the present invention, it is possible to quickly adapt to a change in a data signal.

In the embodiment of FIG. 10, the inverter INV is shown as a CMOS inverter. However, embodiments of the present invention are not limited thereto, and the inverter INV may be implemented by various inverters, for example, by various combinations of a P-type (e.g., P-channel) transistor and/or an N-type (e.g., N-channel) transistor.

In the following, a repair method according to an embodiment of the present invention is described when the light-emitting pixel EPij has a defect due to a pixel circuit defect of the light-emitting pixel EPij.

The light-emitting element E of the defective light-emitting pixel EPij is separated from the defective light-emitting pixel EPij and coupled to (e.g., connected to) the repair line RLj. For example, the light-emitting pixel EPij may include a connection wire 15. One end of the connection wire 15 may be coupled to the repair line RLj, and the other end of the connection wire 15 may overlap with a portion of the anode of the light-emitting element E or with a wire coupled to the anode of the light-emitting element E. The other end of the connection wire 15 may be insulated by an insulating layer.

When a repair is performed, a laser beam may be emitted to cut an area where the anode of the light-emitting element E is coupled to the second electrode of the second transistor T21. In addition, a laser beam may be emitted to an area where the connection wire 15 overlaps with a portion of the anode of the light-emitting element E or with a wire coupled to the anode of the light-emitting element E, to destroy the insulating layer, and to short the portion of the anode or the wire coupled to the anode of the light-emitting element E and the connection wire 15. Thus, the light-emitting element E may be coupled to the repair line RLj. The connection wire 15 may be a wire extended from the repair line RLj or a wire that is formed of a separate conductive material and coupled to the repair line RLj.

In addition, the dummy pixel DPj may be coupled to the repair line RLj, and the repair line RLj may be separated from the first power supply. For example, a laser beam may be emitted to cut an area where the repair line RLj is coupled to the first power supply. In addition, a laser beam may be emitted to an area where the second electrode of the sixth transistor T32 of the dummy pixel EPij overlaps with the repair line RLj to destroy the insulating layer between them, and to short the repair line RLj and the second electrode of the sixth transistor T32. Thus the dummy pixel DPj may be coupled to the repair line RLj.

In the following, a driving method of a defective light-emitting pixel EPij that has been repaired by a dummy pixel DPj according to an embodiment of the present invention is described.

When a dummy scan signal RRSi is supplied from a dummy scan line SL0 or SLn+1, the third transistor T12 of the dummy pixel DPj is turned on to apply a dummy data signal DDj supplied from a data line DLj. A voltage corresponding to the dummy data signal DDj is charged in the second capacitor C12, and the fourth transistor T22 is turned on or off according to the logic level of the dummy data signal DDj. The dummy data signal DDj may be a data signal Dij applied or to be applied to the pixel circuit of the defective light-emitting pixel EPij coupled to the repair line RLj.

When the dummy data signal DDj is in a low level, the inverter INV outputs a high-level signal. Thus, the sixth transistor T32 is turned off, and the fourth transistor T22 of the dummy pixel DPj is turned on. When the fourth transistor T22 is turned on, the fourth transistor T22 applies the first power supply voltage ELVDD to the repair line RLj. A high-level signal of the first power supply voltage ELVDD is applied to the anode of the light-emitting element E of the defective light-emitting pixel EPij through the repair line RLj, and the light-emitting element E emits light.

When the dummy data signal DDj is in a high level, the fourth transistor T22 is turned off, and the sixth transistor T32 is turned on as a result of the inverter INV outputting a low-level signal. If the sixth transistor T32 is turned on, the reset signal RESET is applied to the anode of the light-emitting element E through the repair line RLj to reset the anode. Because the fourth transistor T22 is turned off, the light-emitting element E does not emit light and displays black.

Figure 11:
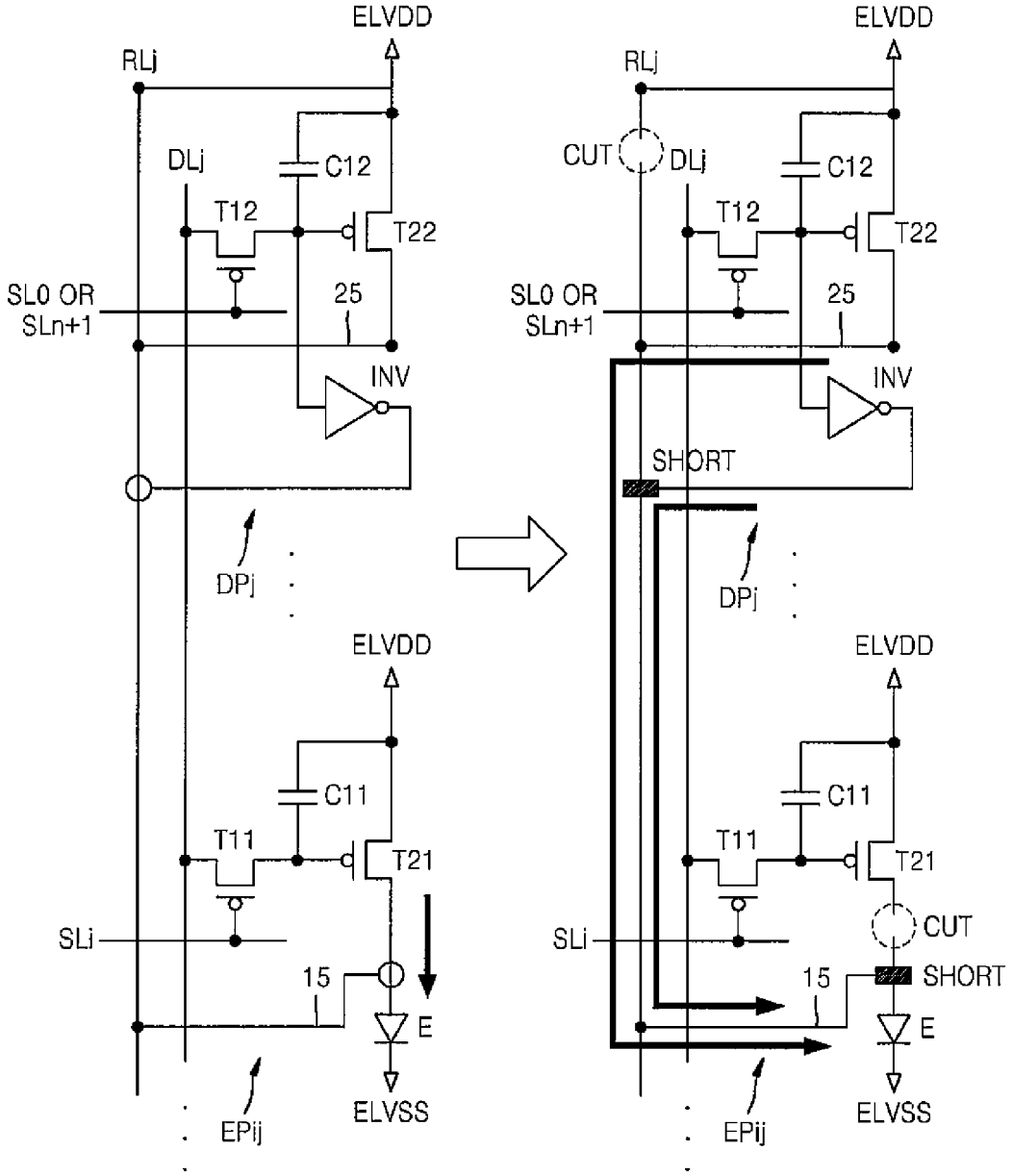

FIG. 11 depicts a method of repairing a defective pixel by using (e.g., utilizing) a repair line according to an embodiment of the present invention.

The circuit on the left-hand side in FIG. 11 shows a dummy pixel DP and a light-emitting pixel EP located in the same pixel column before a repair is performed. The circuit on the right-hand side in FIG. 11 shows a dummy pixel DP and a light-emitting pixel EP located in the same pixel column after a repair is performed.

In FIG. 11, a light-emitting pixel EPij coupled to a jth pixel column and to an ith pixel row, and a dummy pixel DPj coupled to a jth pixel column and to a zeroth or n+1th pixel row are shown as an example. Compared to the embodiment of FIG. 7, the dummy pixel DPj in the embodiment of FIG. 11 further includes an inverter INV. In the following description, content that has been described with reference to the embodiment of FIG. 7 that is substantially similar to the embodiment of FIG. 11 has been omitted.

Referring to FIG. 11, a repair line RLj is arranged (e.g., positioned) next to a data line DLj along a pixel column, and the repair line RLj is coupled to (e.g., connected to) a first power supply configured to supply a first power supply voltage ELVDD.

The light-emitting pixel EPij may include a pixel circuit and a light emitting element E coupled to the pixel circuit. The pixel circuit may include two transistors T11 and T21, and one capacitor C11.

The dummy pixel DPj may include a pixel circuit that includes two transistors T12 and T22, and one capacitor C12.

In the case of a third transistor T12 of the dummy pixel DPj, a gate electrode of the third transistor T12 may be coupled to a dummy scan line SL0 or SLn+1. A first electrode of the third transistor T12 may be coupled to a data line DLj, and a second electrode of the third transistor T12 may be coupled to a gate electrode of a fourth transistor T22. In the case of the fourth transistor T22, the gate electrode of the fourth transistor T22 may be coupled to the second electrode of the third transistor T12, a first electrode of the fourth transistor T22 may be coupled to the first power supply to receive the first power supply voltage ELVDD, and a second electrode of the fourth transistor T22 may be coupled to the repair line RLj. In the case of a second capacitor C12, a first electrode of the second capacitor C12 may be coupled to the second electrode of the third transistor T12 and to the gate electrode of the fourth transistor T22. A second electrode of the second capacitor C12 may be coupled to the first power supply to receive the first power supply voltage ELVDD. In the case of the inverter INV, which inverts and outputs an input signal, an input of the inverter INV may be coupled to the second electrode of the third transistor T12, and an output of the inverter INV may be in a floating state. The inverter INV may apply a reset signal RESET to an anode of the light-emitting element E, while the light-emitting element E of the repaired light-emitting pixel EPij displays black. The power supply of the inverter INV may use (e.g., utilize) the high-level and low-level signals of a data signal Dj. The first power supply voltage ELVDD may be used (e.g., utilized) as the high-level signal of the inverter INV.

When a light-emitting pixel EPij is a defective pixel due to a pixel circuit defect, the light-emitting element E of the defective light-emitting pixel EPij may be separated from a pixel circuit, and coupled to the repair line RLj. For example, the defective light-emitting pixel EPij may include a connection wire 15. One end of the connection wire 15 may be coupled to the repair line RLj, and the other end of the connection wire 15 may overlap with a portion the anode of the light-emitting element E, or with a wire coupled to the anode of the light-emitting element E. The other end of the connection wire 15 may be insulated by an insulating layer. When a repair is performed, a laser beam may be emitted to cut an area where the anode of the light-emitting element E is coupled to the second electrode of the second transistor T21. In addition, a laser beam may be emitted to an area where the connection wire 15 overlaps with a portion of the anode, or a with wire coupled to the anode, to destroy the insulating layer insulating the other end of the connection wire 15. Thus, the anode of the light-emitting element E and the connection wire 15 may be shorted to couple the light-emitting element E to the repair line RLj. The connection wire 15 may be a wire extended from the repair line RLj or a wire that is formed of a separate conductive material and coupled to the repair line RLj.

In addition, the dummy pixel DPj may be coupled to the repair line RLj, and the repair line RLj may be separated from the first power supply. For example, a laser beam may be emitted to cut an area where the repair line RLj is coupled to the first power supply. In addition, a laser beam may be emitted to destroy an insulating layer insulating an area where the output of the inverter INV overlaps with the repair line RLj. Thus, the output of the inverter INV and the repair line RLj may be shorted to couple the dummy pixel DPj to the repair line RLj.

In the following, a driving method of a defective light-emitting pixel EPij that has been repaired by the dummy pixel DPj according to an embodiment of the present invention is described.

When a dummy scan signal RRSi is supplied from the dummy scan line SL0 or SLn+1, the third transistor T12 of the dummy pixel DPj is turned on to apply (e.g., transmit) a dummy data signal DDj supplied from a data line DLj. A voltage corresponding to the dummy data signal DDj is charged in the second capacitor C12, and the fourth transistor T22 is turned on or off according to the logic level of the dummy data signal DDj. The dummy data signal DDj is a data signal Dij applied or to be applied to the pixel circuit of the defective light-emitting pixel EPij coupled to the repair line RLj.

When the dummy data signal DDj is in a low level, the inverter INV outputs a high-level signal to the repair line RLj, and the fourth transistor T22 of the dummy pixel DPj is turned on to apply the first power supply voltage ELVDD to the repair line RLj. A high-level signal of the first power supply voltage ELVDD and a high-level signal of the inverter INV are applied to the anode of the light-emitting element E of the light-emitting pixel EPij through the repair line RLj, and the light-emitting element E emits light.

When the dummy data signal DDj is in a high level, the fourth transistor T22 is turned off, and the inverter INV outputs a low-level signal. A low-level output signal of the inverter INV is applied to the anode of the light-emitting element E through the repair line RLj to reset the anode. Because the fourth transistor T22 is turned off, the light-emitting element E stops emitting light and displays black.

Figure 12:
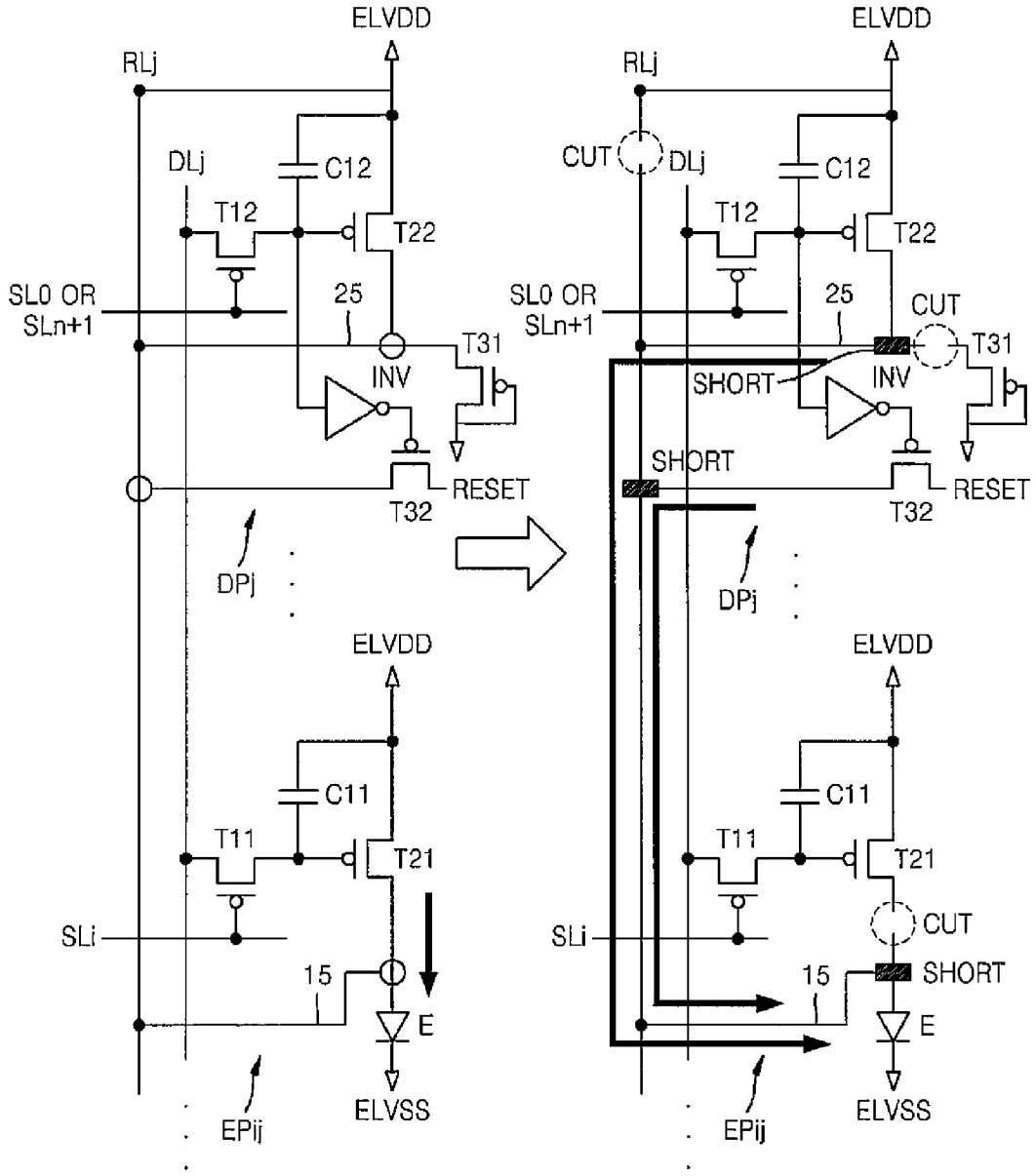

FIG. 12 depicts a method of repairing a defective pixel by using (e.g., utilizing) a repair line according to an embodiment of the present invention.

The circuit on the left-hand side in FIG. 12 shows a dummy pixel DP and a light-emitting pixel EP positioned in the same pixel column before a repair is performed. The circuit on the right-hand side in FIG. 12 shows a dummy pixel DP and a light-emitting pixel EP positioned in the same pixel column after a repair is performed.

In FIG. 12, a light-emitting pixel EPij coupled to a jth pixel column and to an ith pixel row, and a dummy pixel DPj coupled to a jth pixel column and to a zeroth or n−1th pixel row are shown as an example. Compared to the embodiment of FIG. 8, the dummy pixel DPj in the embodiment of FIG. 12 further includes an inverter INV and a sixth transistor T32. In the following description, content that has been described with reference to the embodiment of FIG. 8 that is substantially similar to the embodiment of FIG. 12 has been omitted.

Referring to FIG. 12, a repair line RLj is arranged (e.g., positioned) next to a data line DLj along a pixel column, and the repair line RLj is coupled to (e.g., connected to) a first power supply configured to supply a first power supply voltage ELVDD.

The light-emitting pixel EPij may include a pixel circuit and a light-emitting element E coupled to the pixel circuit. The pixel circuit may include two transistors T11 and T21, and one capacitor C11.

The dummy pixel DPj may include a pixel circuit that includes four transistors T12, T22, T31 and T32, an inverter INV, and one capacitor C12. In another embodiment of the present invention, the fifth transistor T31 may be replaced with the dummy light-emitting element IDE, substantially similar to the one shown in the embodiment of FIG. 9.

In the case of a third transistor T12 of the dummy pixel DPj, a gate electrode of the third transistor T12 may be coupled to a dummy scan line SL0 or SLn+1. A first electrode of the third transistor T12 may be coupled to a data line DLj, and a second electrode of the third transistor T12 may be coupled to (e.g., connected to) a gate electrode of a fourth transistor T22. In the case of the fourth transistor T22, the gate electrode of the fourth transistor T22 may be coupled to the second electrode of the third transistor T12, a first electrode of the fourth transistor T22 may be coupled to the first power supply to receive the first power supply voltage ELVDD, and a second electrode of the fourth transistor T22 may be coupled to a first electrode of a fifth transistor T31. In the case of the fifth transistor 131, a gate electrode and a second electrode of the fifth transistor T31 may be coupled to a second power supply to receive a second power supply voltage ELVSS, and the first electrode of the fifth transistor T31 may be coupled to the second electrode of the fourth transistor T22. In the case of a second capacitor C12, a first electrode of the second capacitor C12 may be coupled to the second electrode of the third transistor T12 and to the gate electrode of the fourth transistor T22. A second electrode of the second capacitor C12 may be coupled to the first power supply to receive the first power supply voltage ELVDD. In the case of the inverter INV, which inverts and outputs an input signal, an input of the inverter INV may be coupled to the second electrode of the third transistor T12, and an output of the inverter INV may be coupled to a gate electrode of a sixth transistor T32. In the case of the sixth transistor T32, the gate electrode of the sixth transistor T32 may be coupled to the output of the inverter INV, a first electrode of the sixth transistor T32 may be coupled to a reset power supply that applies a reset signal RESET, and a second electrode of the sixth transistor T32 may be in a floating state.

When a light-emitting pixel EPij is a defective pixel due to a pixel circuit defect, the light-emitting element E of the defective light-emitting pixel EPij may be separated from the pixel circuit, and coupled to the repair line RLj. For example, the light-emitting pixel EPij may include a connection wire 15. One end of the connection wire 15 may be coupled to the repair line RLj, and the other end of the connection wire 15 may overlap with a portion of the anode of the light-emitting element E, or with a wire coupled to the anode of the light-emitting element E. The other end of the connection wire 15 may be insulated by an insulating layer. When a repair is performed, a laser beam may be emitted to cut an area where the anode of the light-emitting element E is coupled to the second electrode of the second transistor T21. In addition, a laser beam may be emitted to an area where the connection wire 15 overlaps with a portion of the anode of the light-emitting element E, or with a wire coupled to the anode, to destroy the insulating layer insulating the other end of the connection wire 15, and to short the portion of the anode of the light-emitting element E, or the wire coupled to the anode, and the connection wire 15. Thus, the light-emitting element E may be coupled to the repair line RLj. The connection wire 15 may be a wire extended from the repair line RLj or a wire that is formed of a separate conductive material and coupled to the repair line RLj.

In addition, the fifth transistor T31 of the dummy pixel DPj may be separated from the dummy pixel DPj, the dummy pixel DPj may be coupled to the repair line RLj, and the repair line RLj may be separated from the first power supply. For example, the dummy pixel DPj may include a connection wire 25. One end of the connection wire 25 may be coupled to the repair line RLj, and the other end of the connection wire 25 may overlap with the second electrode of the fourth transistor T22. The other end of the connection wire 25 may be insulated by an insulating layer. When a repair is performed, a laser beam may be emitted to cut an area where the repair line RLj is coupled to the first power supply. In addition, a laser beam may be emitted to cut an area where the second electrode of the fourth transistor T22 is coupled to the first electrode of the fifth transistor T31. In addition, a laser beam may be emitted to an area where the connection wire 25 overlaps with the second electrode of the fourth transistor T22 to destroy the insulating layer insulating the other end of the connection wire 25. Thus, the connection wire 25 and the second electrode of the fourth transistor T21 may be shorted. The connection wire 25 may be a portion of the repair line RLj or may be a wire that is formed of a separate conductive material and coupled to the repair line RLj. In addition, a laser beam may be emitted to an area where the second electrode of the sixth transistor T32 of the dummy pixel EPij overlaps with the repair line RLj, to destroy an insulating layer between them, and to short the repair line RLj and the second electrode of the sixth transistor T32. Accordingly, the dummy pixel DPj may be coupled to the repair line RLj.

In the following description, a driving method of a defective light-emitting pixel EPij that has been repaired by the dummy pixel DPj according to an embodiment of the present invention is described.

When a dummy scan signal RRSi is supplied from the dummy scan line SL0 or SLn+1, the third transistor T12 of the dummy pixel DPj is turned on to apply a dummy data signal DDj supplied from a data line DLj. A voltage corresponding to the dummy data signal DDj is charged in the second capacitor C12, and the fourth transistor T22 is turned on or off according to the logic level of the dummy data signal DDj. The dummy data signal DDj is a data signal Dij applied or to be applied to the pixel circuit of the defective light-emitting pixel EPij coupled to the repair line RLj.

When the dummy data signal DDj is in a low level, the inverter INV outputs a high-level signal. Thus, the sixth transistor T32 is turned off and the fourth transistor T22 is turned on. When the fourth transistor T22 is turned on, the fourth transistor T22 applies the first power supply voltage ELVDD to the repair line RLj. A high-level signal of the first power supply voltage ELVDD is applied to the anode of the light-emitting element E of the defective light-emitting pixel EPij through the repair line RLj, and the light-emitting element E emits light.

When the dummy data signal DDj is in a high level, the fourth transistor T22 is turned off, and the sixth transistor T32 is turned on because the inverter INV outputs a low-level signal. When the sixth transistor T32 is turned on, a reset signal RESET is applied to the anode of the light-emitting element E through the repair line RLj to reset the anode. Because the fourth transistor T22 is turned off, the light-emitting element E stops emitting light and displays black.

Figure 13:
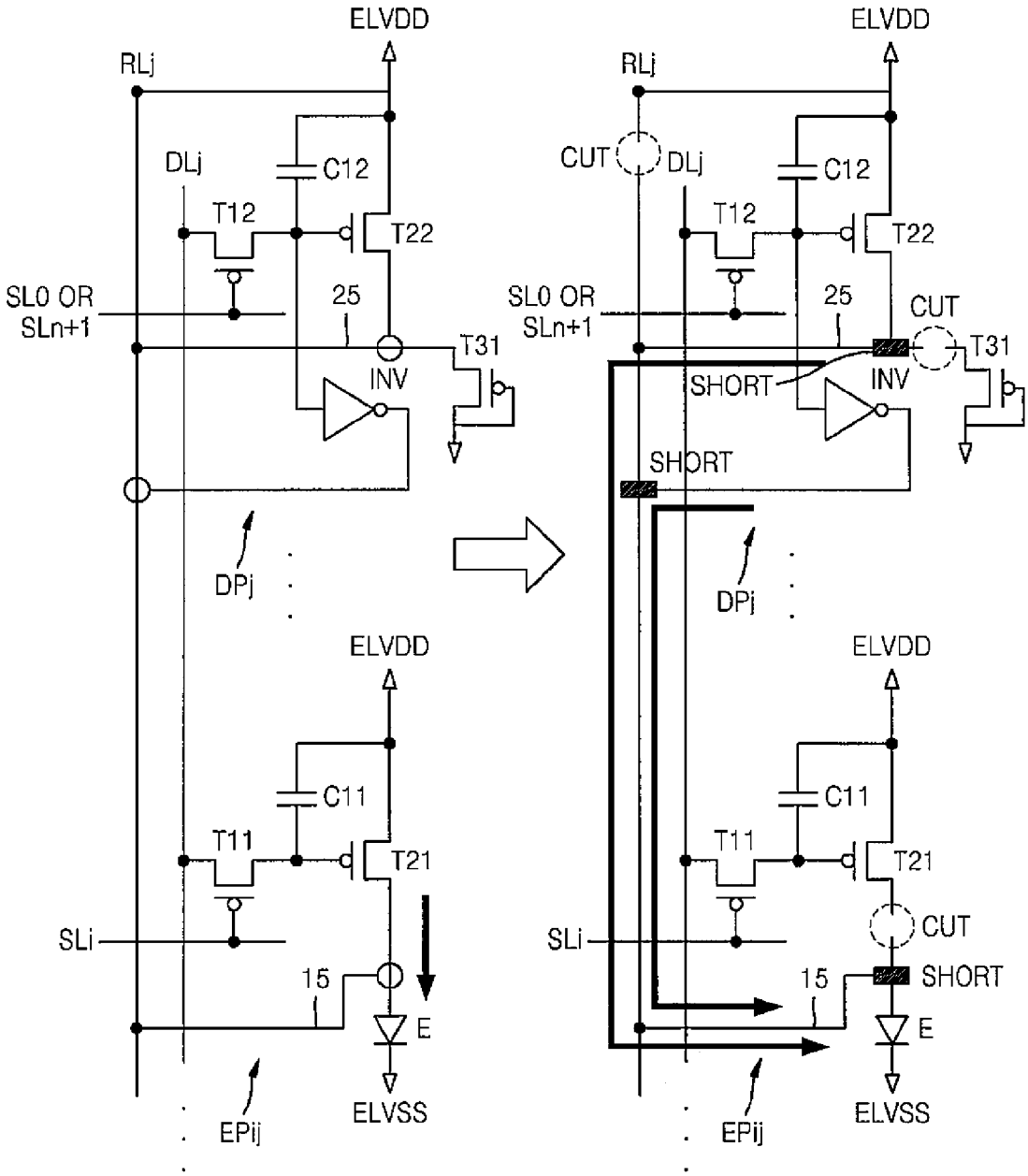

FIG. 13 depicts a method of repairing a defective pixel by using (e.g., utilizing) a repair line according to an embodiment of the present invention.

The circuit on the left-hand side in FIG. 13 shows a dummy pixel DP and a light-emitting pixel EP positioned in the same pixel column before a repair is performed. The circuit on the right-hand side in FIG. 13 shows a dummy pixel DP and a light-emitting pixel EP positioned in the same pixel column after a repair is performed.

In FIG. 13, a light-emitting pixel EPij coupled to a jth pixel column and to an ith pixel row, and a dummy pixel DPj coupled to a jth pixel column and to a zeroth or n+1th pixel row are shown as an example. Compared to the embodiment of FIG. 8, the dummy pixel DPj in the embodiment of FIG. 13 further includes an inverter INV. In the following description, content that has been described with reference to the embodiment of FIG. 8 that is substantially similar to the embodiment of FIG. 13 has been omitted.

Referring to FIG. 13, a repair line RLj is arranged (e.g., positioned) next to a data line DLj along a pixel column, and the repair line RLj is coupled to (e.g., connected to) a first power supply configured to supply a first power supply voltage ELVDD.

The light-emitting pixel EPij may include a pixel circuit and a light-emitting element E coupled to the pixel circuit. The pixel circuit may include two transistors T11 and T21, and one capacitor C11.

The dummy pixel DPj may include a pixel circuit that includes three transistors T12, T22 and T31, and one capacitor C12. In another embodiment of the present invention, a fifth transistor T31 may be replaced with the dummy light-emitting element DE, substantially similar to the one shown in the embodiment of FIG. 9.

In the case of a third transistor T12 of the dummy pixel DPj, a gate electrode of the third transistor T12 may be coupled to a dummy scan line SL0 or SLn+1. A first electrode of the third transistor T12 may be coupled to a data line DLj, and a second electrode of the third transistor T12 may be coupled to a gate electrode of a fourth transistor T22. In the case of the fourth transistor T22, the gate electrode of the fourth transistor T22 may be coupled to the second electrode of the third transistor T12, a first electrode of the fourth transistor T22 may be coupled to the first power supply to receive the first power supply voltage ELVDD, and a second electrode of the fourth transistor T22 may be coupled to a first electrode of a fifth transistor T31. In the case of the fifth transistor T31, a gate electrode and a second electrode of the fifth transistor T31 may be coupled to a second power supply to receive a second power supply voltage ELVSS, and the first electrode of the fifth transistor T31 may be coupled to the second electrode of the fourth transistor T22. In the case of a second capacitor C12, a first electrode of the second capacitor C12 may be coupled to the second electrode of the third transistor T12 and to the gate electrode of the fourth transistor T22, and a second electrode of the second capacitor C12 may be coupled to the first power supply to receive the first power supply voltage ELVDD. In the case of the inverter INV, which inverts and outputs an input signal, an input of the inverter INV may be coupled to the second electrode of the third transistor T12, and an output of the inverter INV may be in a floating state.

When a light-emitting pixel EPij is a defective pixel due to a pixel circuit defect, the light-emitting element E of the defective light-emitting pixel EPij may be separated from the pixel circuit and coupled to the repair line RLj. For example, the light-emitting pixel EPij may include a connection wire 15. One end of the connection wire 15 may be coupled to the repair line RLj. The other end of the connection wire 15 may overlap with a portion of the anode of the light-emitting element E, or with a wire coupled to the anode of the light-emitting element E. The other end of the connection wire 15 may be insulated by an insulating layer. When a repair is performed, a laser beam may be emitted to cut an area where the anode of the light-emitting element E is coupled to the second electrode of the second transistor T21. In addition, a laser beam may be emitted to an area where the connection wire 15 overlaps with a portion of the anode of the light-emitting element E, or a wire coupled to the anode, to destroy the insulating layer insulating the other end of the connection wire 15, and to short the anode of the light-emitting element E and the connection wire 15. Thus, the light-emitting element E may be coupled to (e.g., connected to) the repair line RLj. The connection wire 15 may be a wire extended from the repair line RLj or a wire that is formed of a separate conductive material and coupled to the repair line RLj.

In addition, the dummy pixel DPj may be coupled to the repair line RLj, and the repair line RLj may be separated from the first power supply. For example, the dummy pixel DPj may include a connection wire 25. One end of the connection wire 25 may be coupled to the repair line RLj, and the other end of the connection wire 25 may overlap with the second electrode of the fourth transistor T22. The other end of the connection wire 25 may be insulated by an insulating layer. When a repair is performed, a laser beam may be emitted to cut an area where the repair line RLj is coupled to the first power supply. In addition, a laser beam may be emitted to cut an area where the second electrode of the fourth transistor T22 is coupled to the first electrode of the fifth transistor T31. In addition, a laser beam may be emitted to an area where the connection wire 25 overlaps with the second electrode of the fourth transistor T22, to destroy the insulating layer and to short the connection wire 25 and the second electrode of the fourth transistor T22. The connection wire 25 may be a portion of the repair line RLj or may be a wire formed of a separate conductive material. In addition, a laser beam may be emitted to an area where the repair line RLj overlaps with the output of the inverter INV to destroy an insulating layer between the repair line RLj and the output of the inverter INV, and to short the repair line RLj and the output of the inverter INV. Accordingly, the dummy pixel DPj may be coupled to the repair line RLj.

In the following description, a driving method of a defective light-emitting pixel EPij that has been repaired by the dummy pixel DPj according to an embodiment of the present invention is described.

When a dummy scan signal RRSi is supplied from the dummy scan line SL0 or SLn+1, the third transistor T12 of the dummy pixel DPj is turned on to apply (e.g., transmit) a dummy data signal DDj supplied from a data line DLj. A voltage corresponding to the dummy data signal DDj is charged in the second capacitor C12, and the fourth transistor T22 is turned on or off according to the logic level of the dummy data signal DDj. The dummy data signal DDj is a data signal Dij applied or to be applied to the pixel circuit of the defective light-emitting pixel EPij coupled to the repair line RLj.

When the dummy data signal DDj is in a low level, the inverter INV outputs a high-level signal, and the fourth transistor T22 of the dummy pixel DPj is turned on to apply the first power supply voltage ELVDD to the repair line RLj. A high-level signal of the first power supply voltage ELVDD and a high-level signal of the inverter INV are applied to the anode of the light-emitting element E of the light-emitting pixel EPij through the repair line RLj, and the light-emitting element E emits light.

When the dummy data signal DDj is in a high level, the fourth transistor T22 is turned off and the inverter INV outputs a low-level signal. A low-level output signal of the inverter INV is applied to the anode of the light-emitting element E through the repair line RLj to reset the anode. Because the fourth transistor T22 is turned off, the light-emitting element E emits no light and displays black.

Figure 14:
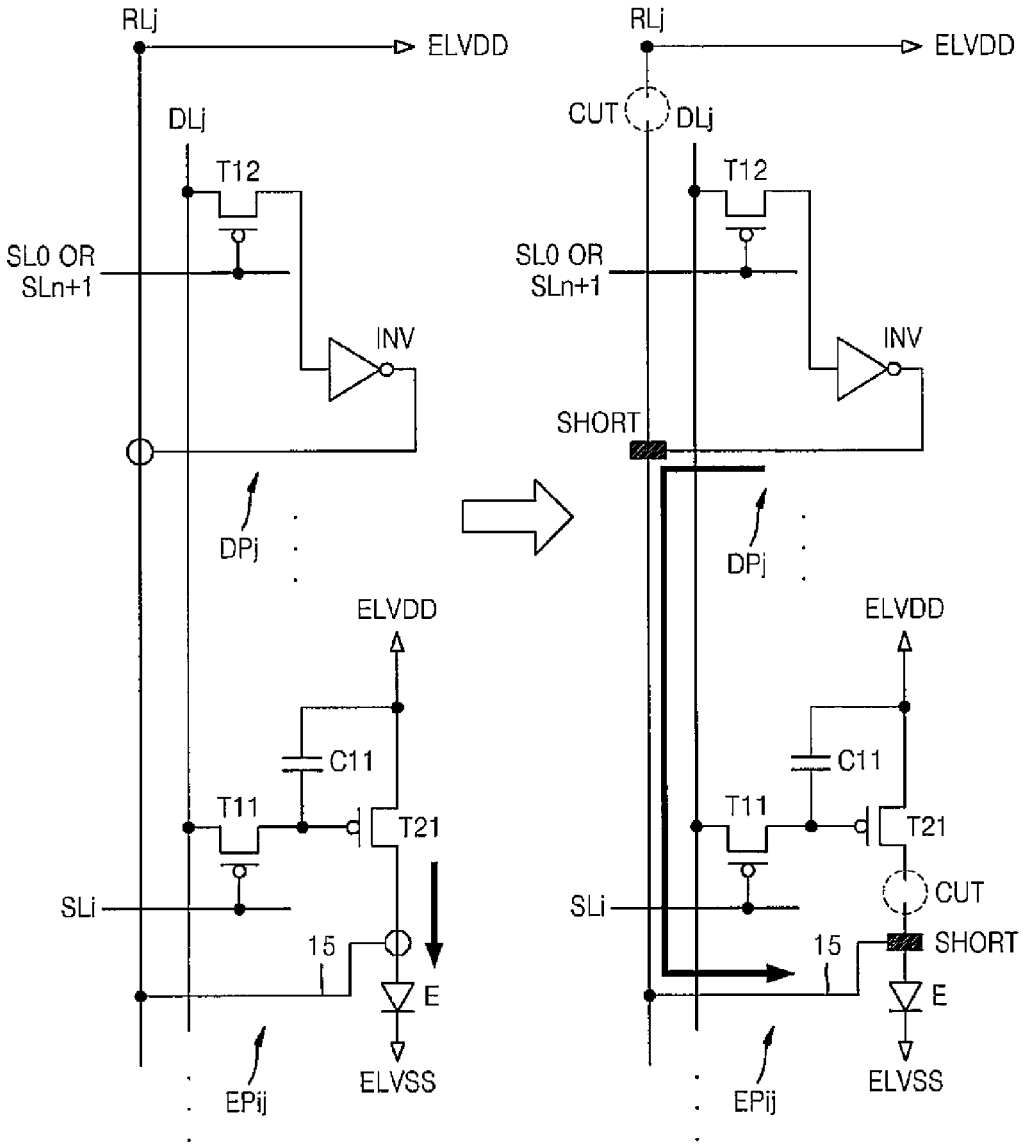

FIG. 14 depicts a method of repairing a defective pixel by using (e.g., utilizing) a repair line according to an embodiment of the present invention.

The circuit on the left-hand side in FIG. 14 shows a dummy pixel DP and a light-emitting pixel EP positioned in the same pixel column before a repair is performed. The circuit on the right-hand side in FIG. 14 shows a dummy pixel DP and a light-emitting pixel EP positioned in the same pixel column after a repair is performed.

In FIG. 14, a light-emitting pixel EPij coupled to a jth pixel column and to an ith pixel row, and a dummy pixel DPj coupled to a jth pixel column and to a zeroth or n+1th pixel row are shown as an example. Compared to the embodiment of FIG. 11, the dummy pixel DPj in the embodiment of FIG. 14 has no second capacitor C12, and no fourth transistor T22. In the following description, content that has been described with reference to the embodiment of FIG. 11 that is substantially similar to the embodiment of FIG. 14 has been omitted.

Referring to FIG. 14, a repair line RLj is arranged (e.g., positioned) next to a data line DLj along a pixel column, and the repair line RLj is coupled to (e.g., connected to) a first power supply configured to supply a first power supply voltage ELVDD.

The light-emitting pixel EPij may include a pixel circuit and a light-emitting element E coupled to the pixel circuit. The pixel circuit may include two transistors T11 and T21, and one capacitor C11.

The dummy pixel DPj may include a pixel circuit that includes one transistor T12 and an inverter INV.

In the case of a third transistor T12 of the dummy pixel DPj, a gate electrode of the third transistor T12 may be coupled to a dummy scan line SL0 or SLn+1. A first electrode of the third transistor T12 may be coupled to a data line DLj, and a second electrode of the third transistor T12 may be coupled to the input of the inverter INV. In the case of the inverter INV, an input of the inverter INV may be coupled to the second electrode of the third transistor T12, and an output of the inverter INV may be in a floating state.

In the following description, a driving method of a light-emitting pixel EPij that drives normally as a normal pixel according to an embodiment of the present invention is described.

When a scan signal Si is supplied from the scan line SLi, the first transistor T11 of the light-emitting pixel EPij is turned on to apply (e.g., transmit) a data signal Dij supplied from the data line DLj. A voltage corresponding to the data signal Dij is charged in the first capacitor C11 and the second transistor T21 is turned on or off according to the logic level of the data signal Dij. When the second transistor T21 is turned on, the first power supply voltage ELVDD is applied to the anode of the light-emitting element E, and the light-emitting element E emits light.

When a dummy scan signal RRSi is supplied from the dummy scan line SL0 or SLn+1, the third transistor T12 of the dummy pixel DPj is turned on to apply a dummy data signal DDj supplied from the data line DLj. The inverter INV inverts the logic level of the dummy data signal DDj and outputs the inverted value. The dummy data signal DDj may be a data signal D1*j* applied to a light-emitting pixel EP1*j* coupled to a first scan line SL1 in the same pixel column, or a data signal Dnj applied to a light-emitting pixel EPnj coupled to an nth scan line SLn.

When a light-emitting pixel EPij is a defective pixel due to a pixel circuit defect, the light-emitting element E of the defective light-emitting pixel EPij may be separated from the pixel circuit and coupled to the repair line RLj. For example, the light-emitting pixel EPij may include a connection wire 15. One end of the connection wire 15 may be coupled to the repair line RLj, and the other end of the connection wire 15 may overlap with a portion of the anode of the light-emitting element E, or with a wire coupled to the anode of the light emitting element E. The other end of the connection wire 15 may be insulated by an insulating layer. When a repair is performed, a laser beam may be emitted to cut an area where the anode of the light-emitting element E is coupled to the second electrode of the second transistor T21. In addition, a laser beam may be emitted to an area where the connection wire 15 overlaps with a portion of the anode of the light-emitting element E, or with a wire coupled to the anode, to destroy the insulating layer insulating the other end of the connection wire 15, and to short the anode of the light-emitting element E and the connection wire 15. Thus, the light-emitting element E may be coupled to (e.g., connected to) the repair line RLj. The connection wire 15 may be a wire extended from the repair line RLj or a wire that is formed of a separate conductive material and coupled to the repair line RLj.

In addition, the dummy pixel DPj may be coupled to the repair line RLj, and the repair line RLj may be separated from the first power supply. For example, a laser beam may be emitted to cut an area where the repair line RLj is coupled to the first power supply. In addition, a laser beam may be emitted to an area where the repair line RLj overlaps with the output of the inverter INV, to destroy an insulating layer between the repair line RLj and the output of the inverter INV, and to short the repair line RLj and the output of the inverter INV. Thus, the dummy pixel DPj may be coupled to the repair line RLj.

In the following, a driving method of a defective light-emitting pixel EPij that has been repaired by the dummy pixel DPj according to an embodiment of the present invention is described.

When a dummy scan signal RRSi is supplied from the dummy scan line SL0 or SLn+1, the third transistor T12 of the dummy pixel DPj is turned on to apply (e.g., transmit) a dummy data signal DDj supplied from the data line DLj. The inverter INV inverts the dummy data signal DDj and outputs the inverted value. The dummy data signal DDj may be a data signal Dij applied or to be applied to the pixel circuit of the defective light-emitting pixel EPij coupled to the repair line RLj.

When the dummy data signal DDj is in a low level, the inverter INV outputs a high-level signal to the repair line RLj. A high-level signal of the inverter INV is applied to the anode of the light-emitting element E of the light-emitting pixel EPij through the repair line RLj, and the light-emitting element E emits light.

When the dummy data signal DDj is in a high level, the inverter INV outputs a low-level signal to the repair line RLj. A low-level signal of the inverter INV is applied to the anode of the light-emitting element E of the light-emitting pixel EPij through the repair line RLj, the anode of the light-emitting element E is reset, and the light-emitting element E does not emit light and displays black.

Embodiments of the present invention may repair defective pixels and normally drive the defective pixels, so that a production yield of a display apparatus may be raised.

Also, by improving a luminescence difference due to the operation difference between a repaired pixel and a normal pixel according to a method of driving the display apparatus, it may be possible to provide a display apparatus that has an improved display quality.

The embodiments described herein have been provided as examples only and should not be construed as limiting the embodiments of the present invention in any way. Accordingly, it will be understood by those skilled in the art that various modifications in form and detail may be made without departing from the spirit and scope of the present invention as defined in the appended claims, and equivalents thereof.

What is claimed is:

1. An organic light-emitting display apparatus comprising:

a light-emitting pixel on a display area, the light-emitting pixel comprising a light-emitting element and configured to emit light through the light-emitting element according to a logic level of a data signal applied during each of a plurality of subfields constituting a frame to adjust an emission time;

a dummy pixel on a dummy area adjacent to the display area; and a repair line on the display area and the dummy area, the repair line being configured to couple the dummy pixel to the light-emitting element of the light-emitting pixel when the light-emitting element is decoupled from the light-emitting pixel, to provide a path to control a light emission of the light-emitting element that is decoupled from the light-emitting pixel according to a logic level of a dummy data signal applied to the dummy pixel.

2. The organic light-emitting display apparatus of claim 1, wherein the dummy pixel is coupled to a dummy scan line positioned on the dummy area, and the dummy scan line is a scan line positioned before a first one of a plurality of scan lines or a scan line positioned after a last one of the plurality of scan lines on the display area.

3. The organic light-emitting display apparatus of claim 1, wherein the light-emitting pixel comprises:

a first thin film transistor configured to turn on when a scan signal is applied to a scan line coupled to the first thin film transistor, and to apply the data signal applied to a data line;

a second thin film transistor configured to turn on according to a logic level of the data signal;

a first capacitor configured to store a voltage corresponding to the data signal; and the light-emitting element.

4. The organic light-emitting, display apparatus of claim 1, wherein the dummy pixel comprises:

a third thin film transistor configured to turn on when a dummy scan signal is applied to a dummy scan line coupled to the third thin film transistor, and to apply the dummy data signal applied to a data line;

a fourth thin film transistor configured to turn on according to the logic level of the dummy data signal; and a second capacitor configured to store a voltage corresponding to the dummy data signal.

5. The organic light-emitting display apparatus of claim 4, wherein during a normal mode in which the data signal applied to the light-emitting pixel is used to emit light by the light-emitting element of the light-emitting pixel, the dummy data signal is a data signal applied to a light-emitting pixel coupled to a first scan line on the display area or a data signal applied to a light-emitting pixel coupled to a last scan line on the display area, and during a repair mode in which the dummy data signal applied to the dummy pixel is used to emit light by the light-emitting element of the light-emitting pixel, the dummy data signal is a data signal applied or to be applied to the light-emitting pixel.

6. The organic light-emitting display apparatus of claim 4, wherein the light-emitting element is separated from the light-emitting pixel and coupled to the repair line, the light-emitting element configured to emit light according to a driving voltage received from the fourth thin film transistor coupled to the repair line.

7. The organic light-emitting display apparatus of claim 4, wherein the dummy pixel further comprises:

an inverter coupled to the third thin film transistor, the inverter configured to invert the dummy data signal and to output an inverted signal; and a sixth thin film transistor coupled to a reset power supply configured to supply a reset signal, the sixth thin film transistor configured to turn on and off according to the output signal of the inverter.

8. The organic light-emitting display apparatus of claim 7, wherein the light-emitting element is separated from the light-emitting pixel and coupled to the repair line, the light-emitting element configured to emit light according to a driving voltage received from the fourth thin film transistor coupled to the repair line, and to be reset to display black according to a reset signal received from the sixth thin film transistor coupled to the repair line.

9. The organic light-emitting display apparatus of claim 4, wherein the dummy pixel further comprises an inverter coupled to the third thin film transistor, the inverter configured to invert the dummy data signal and to output an inverted signal.

10. The organic light-emitting display apparatus of claim 9, wherein the light-emitting element is separated from the light-emitting pixel and the light-emitting element, the inverter, and the fourth thin film transistor are each coupled to the repair line, the light-emitting element configured to emit light according to a driving voltage received from the fourth thin film transistor and to reset to display black according to a signal output from the inverter.

11. The organic light-emitting display apparatus of claim 4, wherein the dummy pixel further comprises a diode-coupled fifth thin film transistor coupled to the fourth thin film transistor and to a second power supply configured to supply a second power supply voltage, and wherein the fifth thin film transistor is configured to be decoupled from the dummy pixel when the light-emitting element is decoupled from the light-emitting pixel and coupled to the repair line.

12. The organic light-emitting display apparatus of claim 11, wherein the dummy pixel further comprises:

an inverter coupled to the third thin film transistor, the inverter configured to invert the dummy data signal and to output an inverted signal; and a sixth thin film transistor coupled to a reset power supply configured to supply a reset signal, the sixth thin film transistor configured to turn on according to the output signal of the inverter.

13. The organic light-emitting display apparatus of claim 12, wherein the fifth thin film transistor is separated from the dummy pixel, the light-emitting element is separated from the light-emitting pixel and coupled to the repair line, and the light-emitting element is configured to emit light when a driving voltage is received from the fourth thin film transistor coupled to the repair line, and to be reset to display black when a reset signal is received from the sixth thin film transistor coupled to the repair line.

14. The organic light-emitting display apparatus of claim 11, wherein the dummy pixel further comprises an inverter coupled to the third thin film transistor, the inverter configured to invert the dummy data signal and to output an inverted signal.

15. The organic light-emitting display apparatus of claim 14, wherein the fifth thin film transistor is separated from the dummy pixel, the light-emitting element is separated from the light-emitting pixel and coupled to the repair line, and the light-emitting element is configured to emit light when a driving voltage is received from the fourth thin film transistor coupled to the repair line, and to be reset to display black according to the signal output from the inverter coupled to the repair line.

16. The organic light-emitting display apparatus of claim 4, wherein the dummy pixel further comprises a dummy light-emitting element coupled to the fourth thin film transistor and a second power supply configured to apply a second power supply voltage, the dummy light-emitting element configured to be separated from the dummy pixel when the light-emitting element is separated from the light-emitting pixel and coupled to the repair line.

17. The organic light-emitting display apparatus of claim 1, wherein the dummy pixel comprises:

a third thin film transistor configured to turn on according to a dummy scan signal applied to a dummy scan line to apply a dummy data signal applied to a data line; and an inverter coupled to the third thin film transistor, the inverter configured to invert the dummy data signal and to output an inverted signal.

18. The organic light-emitting display apparatus of claim 17, wherein the inverter is coupled to the repair line, and the light-emitting element is separated from the light-emitting pixel and coupled to the repair line, the light-emitting element configured to emit light according to the signal output by the inverter.

19. An organic light-emitting display apparatus comprising:

a light-emitting pixel coupled to a scan line and to a data line, the light-emitting pixel comprising a light-emitting element and configured to emit light through the light-emitting element according to a logic level of a data signal applied during each of a plurality of subfields constituting a frame to adjust an emission time;

a dummy pixel coupled to a dummy scan line and to the data line, the dummy pixel configured to receive a dummy data signal applied in each of the subfields;

a repair line on a display area and a dummy area, the repair line being configured to couple the dummy pixel to the light-emitting element of the light-emitting pixel when the light-emitting element is decoupled from the light-emitting pixel, to provide a path to control a light emission of the light-emitting element that is decoupled from the light-emitting pixel according to a logic level of the dummy data signal;

a scan driver configured to output a scan signal to the scan line; and a dummy scan driver configured to output a dummy scan signal to the dummy scan line.

20. The organic light-emitting display apparatus of claim 19, wherein the dummy scan line is positioned on a dummy area adjacent to a display area and the dummy scan line is a scan line positioned before a first one of a plurality of scan lines or a scan line positioned after a last one of the plurality of scan lines on the display area, and the dummy data signal is a data signal applied to a light-emitting pixel coupled to a first scan line or a data signal applied to a light-emitting pixel coupled to a last scan line on the display area during a normal mode in which the data signal applied to the light-emitting pixel is used to emit light by the light-emitting element of the light-emitting pixel, and the dummy data signal is a data signal applied or to be applied to the light-emitting pixel in a repair mode in which the dummy data signal applied to the dummy pixel is used to emit light by the light-emitting element of the light-emitting pixel.

* * * * *